US009587480B2

(12) United States Patent
Guerrero et al.

(10) Patent No.: US 9,587,480 B2
(45) Date of Patent: Mar. 7, 2017

(54) CELLAR OIL RECOVERY TECHNIQUES FOR IN SITU OPERATIONS

(71) Applicant: Suncor Energy Inc., Calgary (Alberta) (CA)

(72) Inventors: Uriel Guerrero, Calgary (CA); John Russell Engelman, Calgary (CA)

(73) Assignee: SUNCOR ENERGY INC., Calgary (Alberta) (CA)

( * ) Notice: Subject to any disclaimer, the term of this patent is extended or adjusted under 35 U.S.C. 154(b) by 371 days.

(21) Appl. No.: 14/213,768

(22) Filed: Mar. 14, 2014

(65) Prior Publication Data

US 2014/0262220 A1 Sep. 18, 2014

Related U.S. Application Data

(60) Provisional application No. 61/782,248, filed on Mar. 14, 2013.

(51) Int. Cl.

| | |
|---|---|
| ***E21B 43/24*** | (2006.01) |
| ***E21B 47/00*** | (2012.01) |
| ***E21B 43/30*** | (2006.01) |

(52) U.S. Cl.

CPC ..... *E21B 47/00* (2013.01); *E21B 43/2406* (2013.01); *E21B 43/30* (2013.01)

(58) Field of Classification Search

CPC ..... E21B 43/16; E21B 43/24; E21B 43/2406; E21B 43/2408; E21B 41/0035; E21B 47/00; E21B 43/30

See application file for complete search history.

(56) References Cited

U.S. PATENT DOCUMENTS

| | | | | |
|---|---|---|---|---|
| 7,556,099 | B2 | 7/2009 | Arthur et al. | |
| 8,307,915 | B2 | 11/2012 | Clark et al. | |
| 2003/0106686 | A1* | 6/2003 | Ingle | E21B 43/006 166/245 |
| 2010/0218942 | A1* | 9/2010 | Sanmiguel | E21B 43/24 166/257 |

(Continued)

FOREIGN PATENT DOCUMENTS

| | | | |
|---|---|---|---|
| CA | 2684049 | A1 | 4/2011 |
| CA | 2778135 | A1 | 11/2012 |

*Primary Examiner* — Brad Harcourt
(74) *Attorney, Agent, or Firm* — Baker & Hostetler LLP

(57) ABSTRACT

Techniques for recovering hydrocarbons, such as heavy hydrocarbons or bitumen, from a cellar region below a horizontal production well can include providing a cellar well section that extends from the horizontal production well into the cellar region. The horizontal production well can be part of a Steam-Assisted Gravity Drainage (SAGD) in situ recovery system, which forms a hydrocarbon depleted region and a hydrocarbon bearing cellar region. The cellar region includes hydrocarbons that have been pre-heated by SAGD operations. One or more cellar well sections are provided from the SAGD production well to extend into the cellar region, in order to form a branched production well. A pressurizing gas can be injected into the hydrocarbon depleted region from a SAGD injection well, in order to provide sufficient pressure to promote production of pre-heated hydrocarbons from the cellar region through the cellar well section. A branch well section can also be provided from a horizontal production well into a pre-heated adjacent region.

49 Claims, 19 Drawing Sheets

(56) References Cited

U.S. PATENT DOCUMENTS

| | | | | |
|---|---|---|---|---|
| 2011/0174488 | A1* | 7/2011 | Morris | E21B 43/16 166/305.1 |
| 2012/0193094 | A1 | 8/2012 | Arthur et al. | |
| 2014/0124194 | A1* | 5/2014 | Jorshari | E21B 43/2406 166/245 |

* cited by examiner

CELLAR OIL RECOVERY TECHNIQUES FOR IN SITU OPERATIONS

TECHNICAL FIELD

The general technical field relates to in situ hydrocarbon recovery and, in particular, to various techniques for recovering hydrocarbons, such as heavy hydrocarbons or bitumen, from a cellar region in an in-situ hydrocarbon recovery operation.

BACKGROUND

There are a number of in situ techniques for recovering hydrocarbons, such as heavy oil and bitumen, from subsurface reservoirs. Thermal in situ recovery techniques often involve the injection of a heating fluid, such as steam, in order to heat and thereby reduce the viscosity of the hydrocarbons to facilitate recovery.

One technique, called Steam-Assisted Gravity Drainage (SAGD), has become a widespread process for recovering heavy oil and bitumen particularly in the oil sands of northern Alberta. The SAGD process involves well pairs, each pair having two horizontal wells drilled in the reservoir and aligned in spaced relation one on top of the other. The upper horizontal well is a steam injection well and the lower horizontal well is a production well.

Another technique, called Cyclic Steam Stimulation (CSS), is used to cyclically inject steam and then produce hydrocarbons from the same well.

Numerous wells or well pairs are usually provided in groups extending from central pads for hundreds of meters often in parallel relation to one another in order to recover hydrocarbons from a reservoir.

For such thermal in situ recovery operations utilizing steam injection, a steam chamber is formed and tends to grow upward and outward within the reservoir, heating the bitumen or heavy hydrocarbons sufficiently to reduce the viscosity and allow the hydrocarbons and condensed water to flow downward toward the production well. Over time, the steam chambers expand and can coalesce. Eventually, the economics of hydrocarbon recovery begin to decline, for example as the steam-to-oil ratio (SOR) increases.

Despite the reduced economic viability of mature thermal in situ recovery operations, the reservoir often includes a significant amount of unrecovered hydrocarbons as well as a peripheral region around the steam chamber that was heated due to the presence of the steam. The heated bitumen or heavy hydrocarbons in these peripheral regions are valuable, but there are challenges related to the efficient recovery of these hydrocarbons.

In some instances, infill wells have been provided in between existing SAGD well pairs in an attempt to recover some of the unrecovered hydrocarbons located in between SAGD well pairs. However, infill wells also leave hydrocarbons in the reservoir.

SUMMARY

In some implementations, there is provided a process for recovering hydrocarbons, comprising:

operating a Steam-Assisted Gravity Drainage (SAGD) in situ recovery system comprising a well pair that includes a generally horizontal SAGD injection well overlying a generally horizontal SAGD production well, thereby forming a hydrocarbon depleted region above the well pair and a hydrocarbon bearing cellar region below the well pair, the cellar region comprising hydrocarbons that have been pre-heated by the SAGD in situ recovery system;

providing at least one cellar well section extending from the SAGD production well into the cellar region, in order to form a branched production well; and injecting a pressurizing gas into the hydrocarbon depleted region from the SAGD injection well, in order to provide sufficient pressure to promote production of pre-heated hydrocarbons from the cellar region through the at least one cellar well section.

In some implementations, the cellar well section comprises:

a first portion extending downward from the SAGD production well into the cellar region; and a second portion extending from a lower end of the first portion laterally within the cellar region.

In some implementations, the pressurizing gas comprises a non-condensable gas.

In some implementations, the at least one cellar well section comprises multiple cellar well sections arranged in spaced relation along the SAGD production well.

In some implementations, the cellar well sections are arranged in an alternating configuration so as to extend into the cellar region in alternating lateral directions.

In some implementations, there is provided a process for recovering hydrocarbons, comprising:

operating a thermal in situ recovery system comprising a generally horizontal well in order to recover hydrocarbons from a reservoir, thereby forming a hydrocarbon depleted region above the horizontal well and a hydrocarbon bearing cellar region below the horizontal well, the cellar region comprising hydrocarbons that have been pre-heated by the thermal in situ recovery system;

providing at least one cellar well section extending from the horizontal well into the cellar region, in order to form a branched production well; and operating the branched production well to recover at least a portion of the pre-heated hydrocarbons from the cellar region.

In some implementations, the process includes providing a pressure differential between the hydrocarbon depleted region and the branched production well by injecting a pressurizing gas into the hydrocarbon depleted region.

In some implementations, the pressure differential is at least 500 kPa. In some implementations, the pressure differential is at most 3000 kPa.

In some implementations, the pressurizing gas comprises a non-condensable gas. In some implementations, the pressurizing gas comprises at least one of carbon dioxide, methane, nitrogen, propane, butane, or production gas, or a combination.

In some implementations, the thermal in situ recovery system comprises a Cyclic Steam Stimulation (CSS) system comprising a CSS well that is operated as the horizontal well.

In some implementations, the thermal in situ recovery system comprises an in situ combustion (ISC) system comprising an ISC production well that is operated as the horizontal well.

In some implementations, the thermal in situ recovery system comprises a Steam-Assisted Gravity Drainage (SAGD) system comprising a well pair that includes a generally horizontal SAGD injection well overlying a generally horizontal SAGD production well.

In some implementations, the pressurizing gas is injected via the SAGD injection well.

In some implementations, the process includes providing a gas injection well that is vertical or horizontal extending into the hydrocarbon depleted region in order to inject the pressurizing gas.

In some implementations, the at least one cellar well section comprises multiple cellar well sections extending from the horizontal well.

In some implementations, at least one of the cellar well sections comprises: a generally vertical portion extending downward from the horizontal well; and a slanted or horizontal portion extending laterally outward from the generally vertical portion.

In some implementations, the generally vertical portion and the slanted or horizontal portion are joined by an arcuate portion.

In some implementations, at least one of the cellar well sections comprises at least one branched subsection extending outwardly from the cellar well section.

In some implementations, providing the at least one cellar well section comprises: drilling at least one cellar wellbore extending from a bottom region of the horizontal well.

In some implementations, the drilling of the at least one cellar wellbore is performed after formation of the hydrocarbon depleted region.

In some implementations, the drilling of the at least one cellar wellbore is performed before formation of the hydrocarbon depleted region.

In some implementations, the at least one cellar wellbore comprises a plurality of cellar wellbores.

In some implementations, the process includes completing the cellar wellbores to form the cellar well sections. In some implementations, the completing of the cellar well sections comprises inserting liners into the cellar well sections.

In some implementations, the process includes locating the cellar well section in accordance with a hydrocarbon temperature in the cellar region.

In some implementations, the cellar well sections are located in pre-heated hydrocarbon-containing zones of the cellar region having temperatures of at least 50° C. In some implementations, the cellar well sections are located in pre-heated hydrocarbon-containing zones of the cellar region having temperatures of at least 80° C. In some implementations, the cellar well sections are located in pre-heated hydrocarbon-containing zones of the cellar region having temperatures of at least 100° C.

In some implementations, the process includes locating the cellar well sections in accordance with a hydrocarbon viscosity in the cellar region.

In some implementations, the process includes identifying residual pockets of unrecovered hydrocarbons in the cellar region; and locating the cellar well sections so as to extend into corresponding identified residual pockets.

In some implementations, the process includes identifying an underlying topological base of the reservoir; determining a depth profile of the cellar region by determining distances between the horizontal production well and the underlying topological base along a length of the horizontal production well; and providing the cellar well sections into the cellar region in accordance with the depth profile.

In some implementations, the cellar well sections are located proximate to the underlying topological base. In some implementations, the cellar well sections are provided at a well depth between 1 m and 15 m below the horizontal production well. In some implementations, the cellar well sections are provided at a well depth between 2 m and 10 m below the horizontal production well. In some implementations, the cellar well sections are provided at a well depth between 3 m and 5 m below the horizontal production well.

In some implementations, the thermal in situ recovery system comprises two adjacent SAGD well pairs, and wherein the horizontal production wells of the respective SAGD well pairs have corresponding cellar well sections extending toward each other.

In some implementations, the cellar well sections are arranged in an alternating configuration.

In some implementations, the cellar well sections from one SAGD well pair are arranged in a staggered relationship with respect to the cellar well sections of the adjacent SAGD well pair.

In some implementations, the horizontal production well comprises an infill well located in between two Steam-Assisted Gravity Drainage (SAGD) well pairs or a step-out well located adjacent to one SAGD well pair.

In some implementations, the thermal in situ recovery system comprises a solvent-assisted system in which solvent is injected into the reservoir, and the cellar region comprising hydrocarbons that have been pre-diluted by a portion of the solvent.

In some implementations, there is provided a process for recovering hydrocarbons, comprising:

operating a solvent-assisted in situ recovery system comprising a generally horizontal well in order to recover hydrocarbons from a reservoir, thereby forming a hydrocarbon depleted region above the horizontal well and a hydrocarbon bearing cellar region below the horizontal well, the cellar region comprising hydrocarbons that have been pre-diluted by the solvent-assisted in situ recovery system;

providing at least one cellar well section extending from the horizontal well into the cellar region in order to form a branched production well; and operating the branched production well to recover at least a portion of the pre-diluted hydrocarbons from the cellar region.

In some implementations, the process includes providing a pressure differential between the hydrocarbon depleted region and the branched production well by injecting a pressurizing gas into the hydrocarbon depleted region.

In some implementations, the pressurizing gas comprises a non-condensable gas.

In some implementations, the solvent-assisted in situ recovery system comprises a Steam-Assisted Gravity Drainage (SAGD) well pair that includes a generally horizontal SAGD injection well overlying a generally horizontal SAGD production well, wherein the solvent is injected via the SAGD injection well.

In some implementations, the SAGD production well is operated as the horizontal well from which the at least one cellar well section extends.

In some implementations, the solvent is injected during a start-up phase, a ramp-up phase, a steady-state operational phase, or a wind-down phase of hydrocarbon recovery.

In some implementations, the at least one cellar well section comprises multiple cellar well sections extending from the horizontal well.

In some implementations, at least one of the cellar well sections comprises: a generally vertical portion extending downward from the horizontal well; and a slanted or horizontal portion extending laterally outward from the generally vertical portion.

In some implementations, the process includes locating the cellar well sections in accordance with hydrocarbon dilution in the cellar region.

In some implementations, the process includes locating the cellar well sections in accordance with a diluted hydrocarbon viscosity in the cellar region.

In some implementations, the process includes identifying residual pockets of unrecovered hydrocarbons in the cellar region; and locating the cellar well sections so as to extend into corresponding identified residual pockets.

In some implementations, the process includes identifying an underlying topological base of the reservoir; determining a depth profile of the cellar region by determining distances between the horizontal production well and the underlying topological base along a length of the horizontal production well; and providing the cellar well sections into the cellar region in accordance with the depth profile.

In some implementations, the cellar well sections are located proximate to the underlying topological base.

In some implementations, the horizontal production well comprises an infill well located in between two Steam-Assisted Gravity Drainage (SAGD) well pairs or a step-out well located adjacent to one SAGD well pair.

In some implementations, there is provided a process for recovering hydrocarbons, comprising:

operating a thermal in situ recovery system comprising a generally horizontal well in order to recover hydrocarbons from a reservoir, thereby forming a hydrocarbon depleted region above the horizontal well and a hydrocarbon bearing cellar region below the horizontal well, the cellar region comprising hydrocarbons that have been pre-heated by the thermal in situ recovery system;

wherein the horizontal well comprises a cellar well section extending from the horizontal well into the cellar region for recovering pre-heated hydrocarbons from the cellar region.

In some implementations, the process includes providing a pressure differential between the hydrocarbon depleted region and the branched production well by injecting a pressurizing gas into the hydrocarbon depleted region.

In some implementations, the pressurizing gas comprises a non-condensable gas.

In some implementations, the at least one cellar well section comprises multiple cellar well sections extending from the horizontal well.

In some implementations, the cellar well sections are located proximate to an underlying topological base.

In some implementations, the thermal in situ recovery system comprises a Cyclic Steam Stimulation (CSS) system comprising a CSS well that is operated as the horizontal well.

In some implementations, the thermal in situ recovery system comprises an in situ combustion (ISC) system comprising an ISC production well that is operated as the horizontal well.

In some implementations, the thermal in situ recovery system comprises a Steam-Assisted Gravity Drainage (SAGD) system comprising a well pair that includes a generally horizontal SAGD injection well overlying a generally horizontal SAGD production well.

In some implementations, the horizontal production well comprises an infill well located in between two Steam-Assisted Gravity Drainage (SAGD) well pairs.

In some implementations, the horizontal production well comprises a step-out well located adjacent to one SAGD well pair.

In some implementations, the SAGD production well is operated as the horizontal production well.

In some implementations, the thermal in situ recovery system comprises a solvent-assisted system in which solvent is injected into the reservoir, and the cellar region comprising hydrocarbons that have been pre-diluted by a portion of the solvent.

In some implementations, there is provided a process for providing a branched horizontal well in a thermal in situ recovery system, the thermal in situ recovery system comprising a generally horizontal well in order to recover hydrocarbons from a reservoir, the horizontal well being configured to recover hydrocarbons and form a hydrocarbon depleted region above the horizontal well and a hydrocarbon bearing cellar region located below the horizontal well, the process comprising:

drilling at least one cellar wellbore extending from the horizontal well into the cellar region and configured to recover pre-heated hydrocarbons from the cellar region, the horizontal well and the at least one cellar wellbore forming the branched horizontal well.

In some implementations, the at least one cellar wellbore comprises multiple cellar wellbores arranged in space relation along the horizontal well.

In some implementations, the cellar wellbores are drilled in spaced relation to each other along the horizontal production.

In some implementations, the cellar wellbores are drilled in an alternating configuration so as to extend into the cellar region in alternating lateral directions.

In some implementations, each of the cellar wellbores comprises: a first wellbore portion extending downward from the production well into the cellar region; and a second wellbore portion extending from a lower end of the first portion laterally within the cellar region.

In some implementations, the cellar wellbores are drilled at locations in the cellar region in accordance with a hydrocarbon viscosity in the cellar region.

In some implementations, the cellar wellbores are drilled into pre-determined residual pockets of unrecovered hydrocarbons in the cellar region.

In some implementations, cellar wellbores are drilled into pre-heated hydrocarbon-containing zones of the cellar region.

In some implementations, the cellar wellbores are drilled so as to provide pre-determined well depths in accordance with an underlying topological base of the reservoir.

In some implementations, the process includes completing the cellar wellbores to provide corresponding cellar well sections.

In some implementations, there is provided a process of determining locations to provide cellar well sections extending from a horizontal production well configured to recover hydrocarbons from a reservoir, the process comprising:

identifying recoverable zones of hydrocarbons in a hydrocarbon bearing cellar region located below the horizontal production well; and determining cellar wellbore drilling trajectories each extending from locations along the production well into the recoverable zones in the cellar region.

In some implementations, the step of identifying recoverable zones comprises:

identifying hydrocarbon viscosities in the cellar region that are sufficiently low to enable production via the cellar well sections;

identifying hydrocarbon temperatures in the cellar region that are sufficiently high to enable production via the cellar well sections; and/or identifying hydrocarbon dilution levels in the cellar region that are sufficiently high to enable production via the cellar well sections.

In some implementations, the step of identifying recoverable zones further comprises:

identifying an underlying topological base of the reservoir below the production well, the recoverable zones being vertically defined in between the underlying topological base and the production well.

In some implementations, the step of determining cellar wellbore drilling trajectories comprises:

determining a depth profile of the cellar region by determining distances between the horizontal production well and the underlying topological base along a length of the horizontal production well and/or extending outward from the production well; and planning the cellar wellbore drilling trajectories based on the depth profile to provide the cellar wellbores at or proximate to the underlying topological base and remaining within respective recoverable zones.

In some implementations, the step of identifying recoverable zones further comprises:

collecting information from an observation well provided in the cellar region;

collecting information from temperature sensors provided along the production well; and/or collecting seismic information regarding the cellar region.

In some implementations, there is provide a thermal in situ recovery system for recovering hydrocarbons from a reservoir, the system comprising:

a production well having a generally horizontal portion provided in the reservoir in between an upper hydrocarbon depleted region and a lower hydrocarbon bearing cellar region, the cellar region comprising hydrocarbons that have been pre-heated by the thermal in situ recovery system;

at least one cellar well section extending from the production well into the cellar region, the production well and the at least one cellar well section thereby forming a branched production well for recovering at least a portion of the pre-heated hydrocarbons from the cellar region; and a pressurisation system comprising:

an injection well located in the upper hydrocarbon depleted region and configured to inject a pressurizing gas into the hydrocarbon depleted zone; and a pressure regulator for regulating a downhole pressure differential between the branched production well and the hydrocarbon depleted zone in order to promote production of pre-heated hydrocarbons from the cellar region.

In some implementations, the production well comprises a Steam-Assisted Gravity Drainage (SAGD) production well and the injection well comprises a SAGD injection well overlying the SAGD production well.

In some implementations, the at least one cellar well section comprises multiple cellar well sections extending from the SAGD production well.

In some implementations, at least one of the cellar well sections comprises: a generally vertical portion extending downward from the SAGD production well; and a slanted or horizontal portion extending laterally outward from the generally vertical portion.

In some implementations, the generally vertical portion and the slanted or horizontal portion are joined by an arcuate portion.

In some implementations, at least one of the cellar well sections comprises at least one branched subsection extending outwardly from the cellar well section.

In some implementations, the cellar well sections comprise corresponding slotted liners.

In some implementations, the cellar well sections are located in accordance with a hydrocarbon temperature in the cellar region.

In some implementations, the cellar well sections are located in pre-heated hydrocarbon-containing zones of the cellar region having temperatures of at least 50° C.

In some implementations, the cellar well sections are located in accordance with a depth profile of an underlying topological base of the reservoir.

In some implementations, the cellar well sections are located proximate to the underlying topological base.

In some implementations, the thermal in situ recovery system comprises two adjacent SAGD well pairs, and wherein the SAGD production wells of the respective SAGD well pairs have corresponding cellar well sections extending toward each other.

In some implementations, the cellar well sections are arranged in an alternating configuration.

In some implementations, the cellar well sections from one SAGD well pair are arranged in a staggered relationship with respect to the cellar well sections of the adjacent SAGD well pair.

In some implementations, the horizontal production well comprises an infill well located in between two Steam-Assisted Gravity Drainage (SAGD) well pairs.

In some implementations, the horizontal production well comprises a step-out well located adjacent to one Steam-Assisted Gravity Drainage (SAGD) well pair.

In some implementations, the system includes a solvent injection assembly for injecting solvent into the reservoir, such that the cellar region comprises hydrocarbons that have been pre-diluted by a portion of the solvent.

In some implementations, there is provided a process for recovering hydrocarbons, comprising:

operating a Steam-Assisted Gravity Drainage (SAGD) in situ recovery system comprising a well pair that includes a generally horizontal SAGD injection well overlying a generally horizontal SAGD production well, thereby forming a hydrocarbon depleted region above the well pair and an adjacent hydrocarbon bearing region adjacent to the hydrocarbon depleted region, the adjacent region comprising hydrocarbons that have been pre-heated by the SAGD in situ recovery system;

providing at least one branch well section extending from the SAGD production well and extending into the adjacent region, in order to form a branched production well; and injecting a pressurizing gas into the hydrocarbon depleted region from the SAGD injection well, in order to provide sufficient pressure to promote production of pre-heated hydrocarbons from the adjacent region through the at least one branch well section.

In some implementations, the adjacent region comprises a cellar region located below the SAGD production well, and the branch well section extends downward from the SAGD production well into the cellar region.

In some implementations, the adjacent region is located beside the SAGD production well and the branch well section extends laterally from the SAGD production well into the adjacent region.

In some implementations, there is provided a process for selecting pre-heated hydrocarbon bearing regions for receiving branch well sections, the pre-heated regions being formed by operation of a Steam-Assisted Gravity Drainage (SAGD) in situ recovery system comprising a SAGD injection well overlying a SAGD production well, the process comprising:

identifying a hydrocarbon depleted region above the SAGD production well; and identifying hydrocarbon bearing regions that are adjacent to SAGD production well and the hydrocarbon depleted region;

determining hydrocarbon temperatures of the hydrocarbon bearing regions; and selecting pre-heated hydrocarbon bearing regions having temperatures sufficient to enable hydrocarbon production therefrom via corresponding branch well sections extending from the SAGD production well.

In some implementations, the steps of identifying the hydrocarbon depleted region and identifying hydrocarbon bearing regions comprise seismic surveying.

In some implementations, the step of identifying hydrocarbon bearing regions comprises identifying an underlying topological base of the reservoir below the SAGD production well, the hydrocarbon bearing regions being cellar region that are vertically defined in between the underlying topological base and the production well.

In some implementations, the step of determining hydrocarbon temperatures of the hydrocarbon bearing regions comprises:

measuring temperatures along the SAGD production well or from observation wells; and/or estimating temperatures based on simulations and/or calculations.

Cellar well sections that extend from a horizontal production well into a pre-heated cellar region of the reservoir can facilitate accessing unrecovered pre-heated hydrocarbons without the need for drilling a new independent well from the surface. The cellar well sections can facilitate efficient targeting of unrecovered hydrocarbons that are pre-heated yet not economically recoverable via the horizontal production well itself. Branch well sections can also be used to efficiently recover pre-heated or pre-diluted hydrocarbons from adjacent pre-heated regions.

DETAILED DESCRIPTION

Various techniques for recovering hydrocarbons from a cellar region or a pre-heated adjacent region in an in-situ hydrocarbon recovery operation are described below.

An existing horizontal well that was involved in thermal in situ hydrocarbon recovery and helped form an underlying "cellar" region of pre-heated but unrecovered hydrocarbons, can be used as the main well off of which one of more cellar well sections are drilled into the cellar region and then operated to recover the pre-heated hydrocarbons. Providing cellar well sections facilitates leveraging energy that was previously input into the reservoir but was unable to be used due to the existing well configuration.

Cellar Well Sections in SAGD Operations

Figure 1:
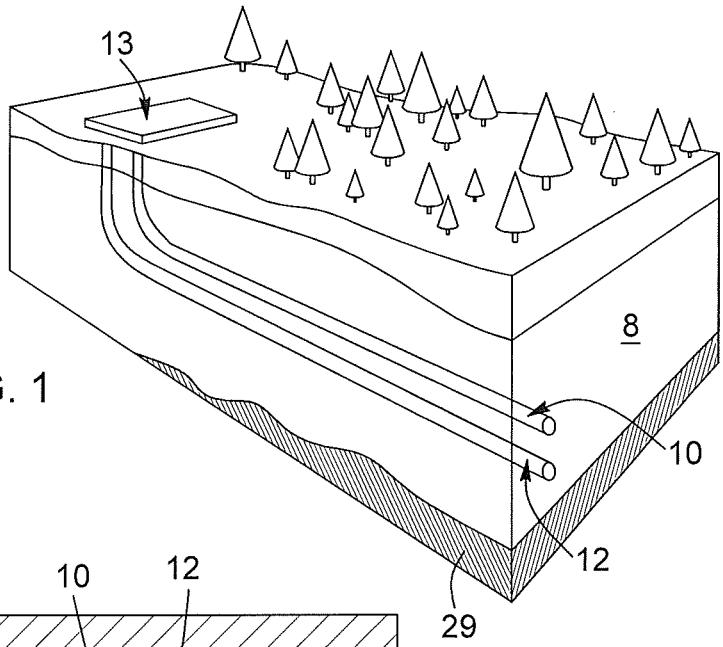
FIG. 1 is perspective cut view schematic of a Steam-Assisted Gravity Drainage (SAGD) well pair.

Referring to FIG. 1, in some implementations the in situ recovery operation that is conducted in the reservoir 8 can be a Steam-Assisted Gravity Drainage (SAGD) operation in which a horizontal injection well 10 is provided overlying a horizontal production well 12 to form a well pair. The well pair extends from a well pad 13 that is located at the surface. Each of the wells has a generally vertical portion extending downward into the reservoir 8 and a generally horizontal portion connected to the vertical portion and extending for several hundred meters.

Figure 2A:
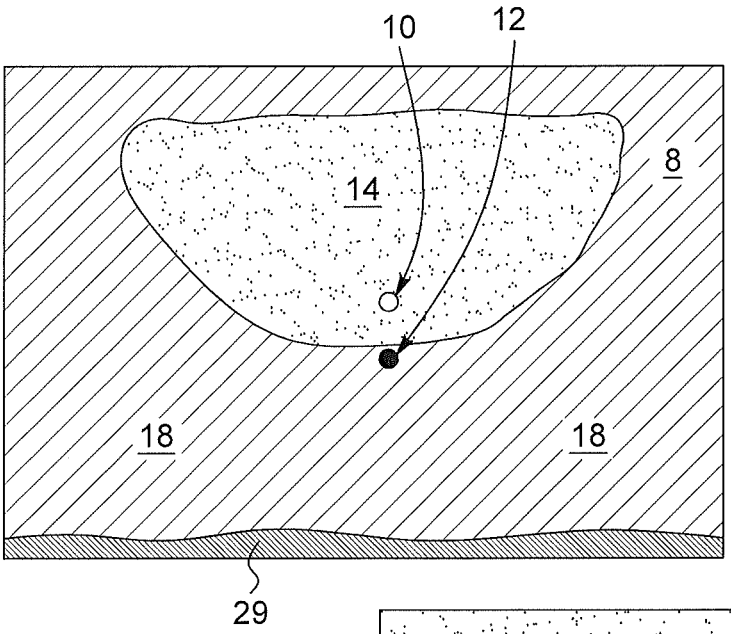
FIGS. 2*a* and 2*b* are front cross-sectional view schematics of a SAGD operation showing one SADG well pair.
Figure 2B:
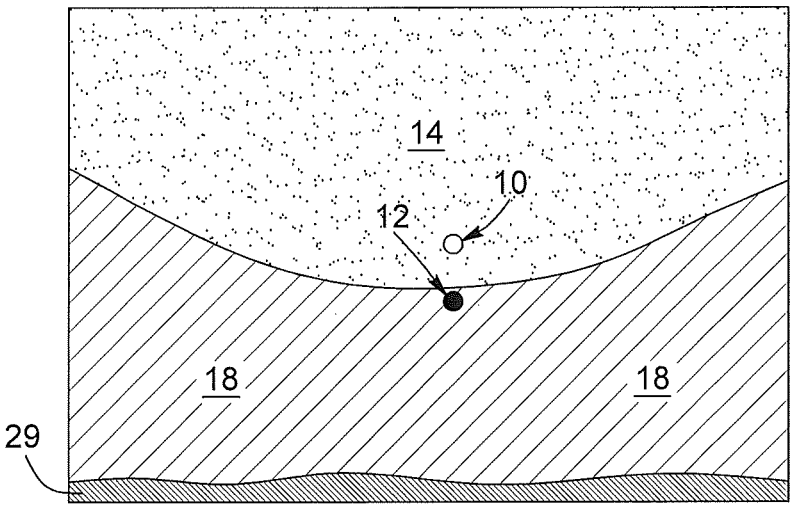

Referring now to FIGS. 2*a* and 2*b*, the injection well 10 and production well 12 are operated to heat the hydrocarbons with steam and recover production fluid that includes mobilized hydrocarbons and condensate. Operation of the SAGD well pair eventually leads to the formation of a steam chamber 14 extending generally upward and outward from the well pair. The steam chamber 14 is a relatively hydrocarbon depleted region that expands due to continued injection of steam. A peripheral hydrocarbon-containing region located around the steam chamber is pre-heated by conduction of the heat from the steam chamber 14.

FIG. 2*a* shows an early stage of the SAGD operation where the steam chamber 14 has grown upward and outward within the reservoir.

FIG. 2*b* shows a more mature stage of the SAGD operation where the steam chamber 14 has continued to grow upward and outward. Notably, the steam chamber 14 has not expanded below the production well 12. At the mature stage of SAGD operation, which often occurs several years after startup, a significant amount of hydrocarbons have been recovered from the region of the reservoir above the production well, thereby forming a hydrocarbon depleted region. A significant amount of hydrocarbons remain unrecovered below the production well 12 in the cellar region 18 and these hydrocarbons have been pre-heated by conduction due to the proximity to the steam chamber 14.

Figure 3A:
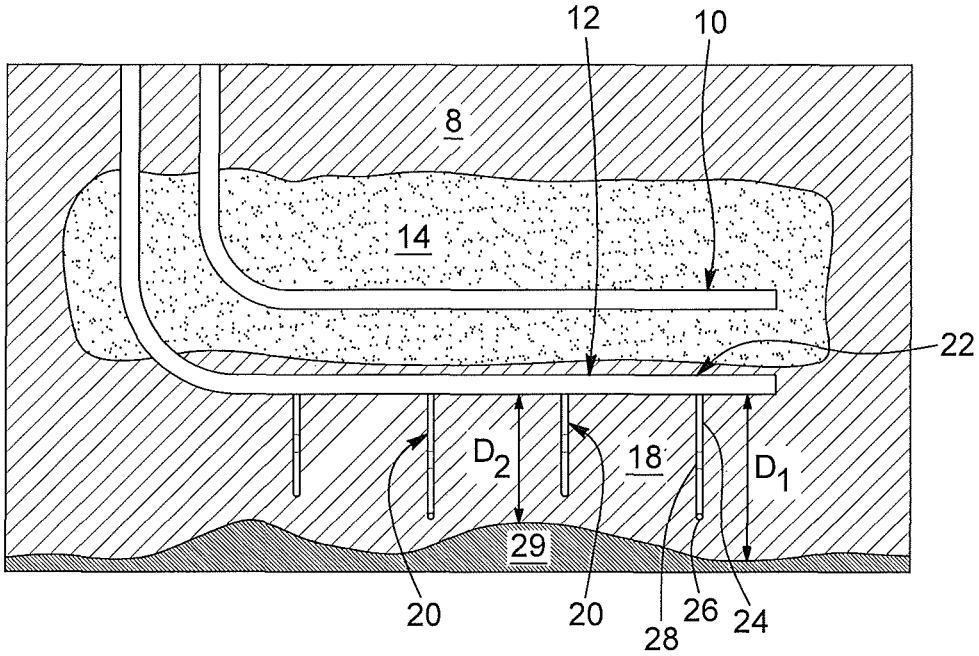
FIGS. 3*a* and 3*b* are respectively a transverse cross-sectional view schematic and a front cross-sectional view schematic of a SAGD operation showing one SADG production well with cellar well sections.
Figure 3B:
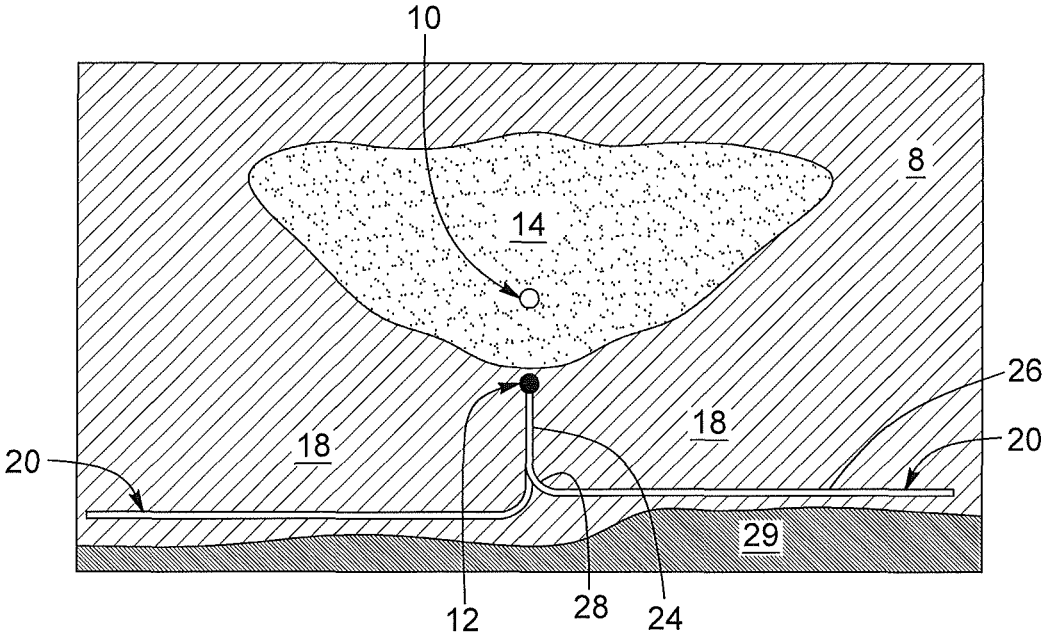

Turning now to FIGS. 3*a* and 3*b*, cellar well sections 20 can be provided extending off of the horizontal production well 12 into the cellar region 18 in order to enable hydrocarbon recovery from that pre-heated region. The production well 12 and the cellar well sections 20 form a branched production well 22. The branched production well 22 can be operated to recover pre-heated hydrocarbons from the cellar region 18. The cellar well sections 20 can have a variety of configurations, as will be discussed in further detail below.

In some implementations, the cellar well sections can be provided during or preceding what would be the wind-up phase of the in-situ recovery operation. More regarding the drilling, completion, timing and operation of the cellar well sections and the branched production well is discussed further below.

Cellar Well Sections in CSS Operations

Figure 24:
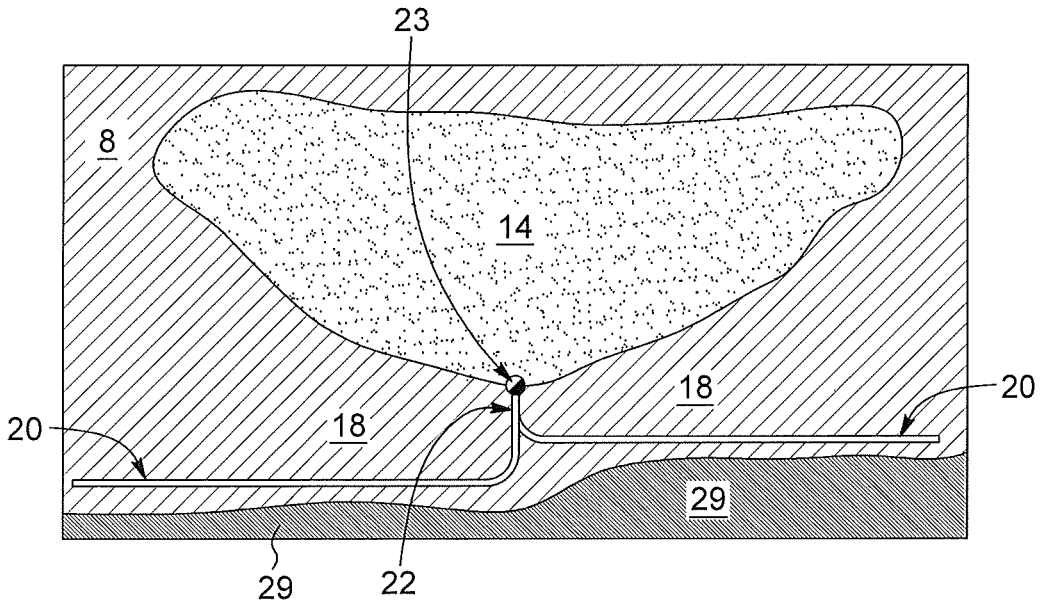
FIG. 24 is a front cross-sectional view schematic of a CSS operation showing a CSS well and cellar well sections.
Figure 25:
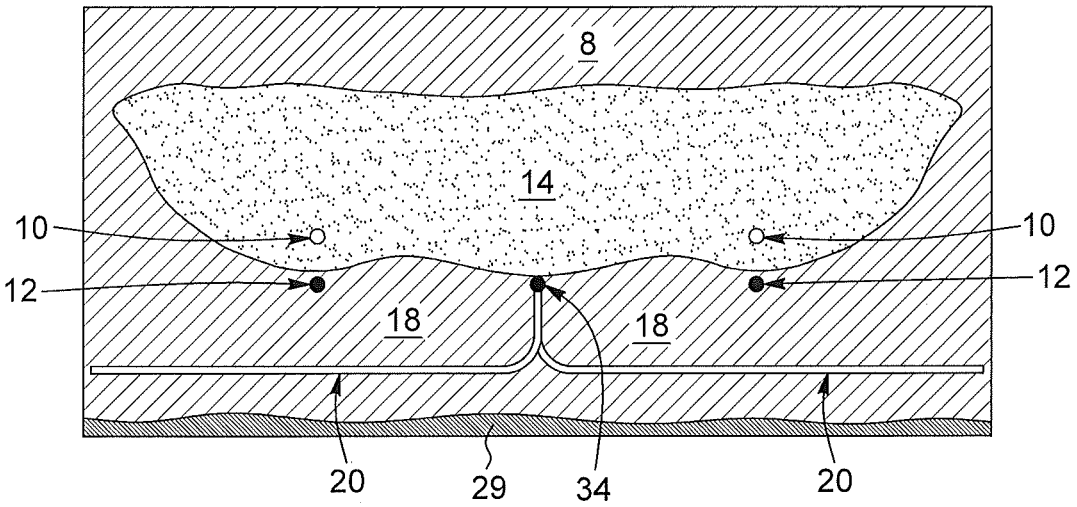
FIG. 25 is a front cross-sectional view schematic of a SAGD operation showing two SADG well pairs and an infill well having cellar well sections.

Referring to FIG. 24, in some implementations the in situ recovery operation that is conducted in the reservoir 8 can be a Cyclic Steam Stimulation (CSS) operation in which a horizontal well 23 is provided and operated with cyclic injection and production cycles. In the CSS scenario, over time a hydrocarbon depleted area/steam chamber 14 and the pre-heated cellar region 18 are formed. It should be noted that due the cyclic nature of CSS operations, the chamber 14 cyclically be filled with steam and then produced to deplete the area of hydrocarbons. The cellar well sections 20 can be provided extending from the horizontal CSS well 23. The branched production well 22 can be operated in CSS or straight production modes, depending on the mobility of the hydrocarbons in the cellar region 18.

Cellar Well Sections in Other In Situ Operations

It should be noted that cellar well sections can be provided so as to extend from various other types of in situ recovery wells that employ thermal and/or solvent assisted techniques for mobilizing the hydrocarbons in the reservoir. Thermal assisted techniques can include wells with injection capabilities for injections steam or other hot fluids or with integrated heating devices. Solvent assisted techniques can include wells for the injection of solvents, such as naphtha, alone or in combination with steam for diluting the hydrocarbons to reduce viscosity. In solvent assisted scenarios, the injected solvent can diffuse downward into the cellar region in order to pre-dilute the region and increase the mobility of the cellar hydrocarbons. In such scenarios, the cellar well not only enables recovery of the cellar hydrocarbons but also some of the solvent that was lost to the cellar region during the previously in situ recovery operation.

It should also be noted that some in situ recovery techniques can use thermal and solvent assisted methods and thus the cellar region can be pre-treated by solvent dilution and pre-heated.

Configurations of the Cellar Well Sections

As will be appreciated from the following discussion, the cellar well sections 20 can have a variety of configurations.

Figure 4:
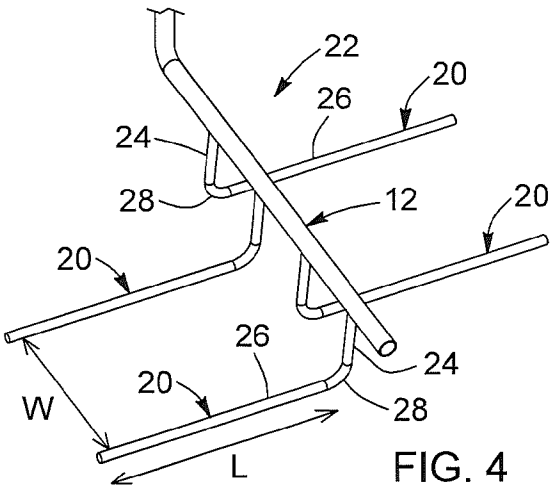

Referring to FIG. 4, each cellar well section 20 can include a generally vertical portion 24 extending downwardly from the horizontal well 12, and a lateral portion 26 extending laterally outward from the generally vertical portion 24. An arcuate portion 28 can connect the vertical portion 24 to the lateral portion 26. The lateral portions 26 can be generally horizontal or slanted, for example.

Figure 5:
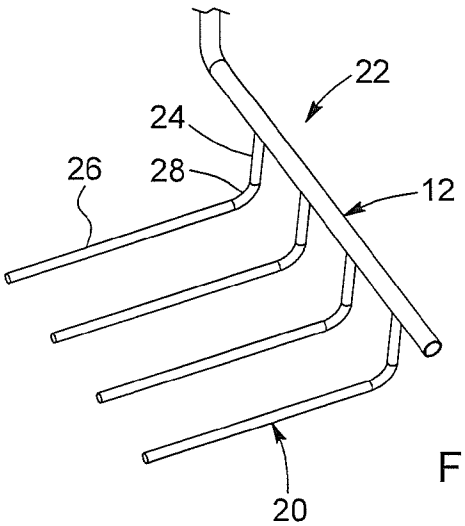
FIGS. 4 to 11 are perspective view schematics of branched production wells with cellar well sections.

Referring to FIGS. 3*a*, 3*b* and 4, the cellar well sections 20 can extend in alternating directions from the horizontal well 12 and can each have a generally similar configuration. FIGS. 3*a* and 3*b* illustrate that the vertical portions 24 of the cellar well sections 20 can extend to different depths, which can depend on the location of the horizontal well 12 and the cellar depth (D) from the horizontal well 12 to the underburden 29 at various positions along the length of the horizontal well 12. FIG. 3*a* illustrates a scenario where the cellar depth D varies along the length of the horizontal well 12, the maximum being at D1 and the minimum being at D2. FIG. 3*b* illustrates a scenario where the underburden 29 varies in a lateral direction, in which case the cellar well sections 20 of one side can be at a lower level than the cellar well sections 20 of the other side:

Referring to FIG. 5, the cellar well sections 20 extend in the same lateral direction from the horizontal well 12 and can be in generally parallel relation to each other.

Figure 6:
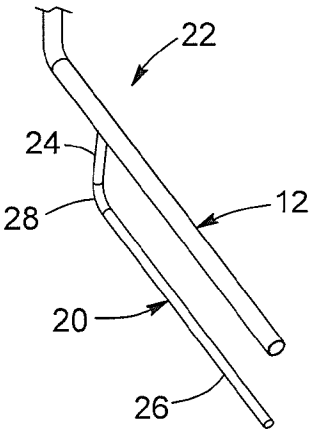

Referring to FIG. 6, the cellar well section 20 can extend below the horizontal well 12 in a generally underlying and parallel relationship.

Figure 7:
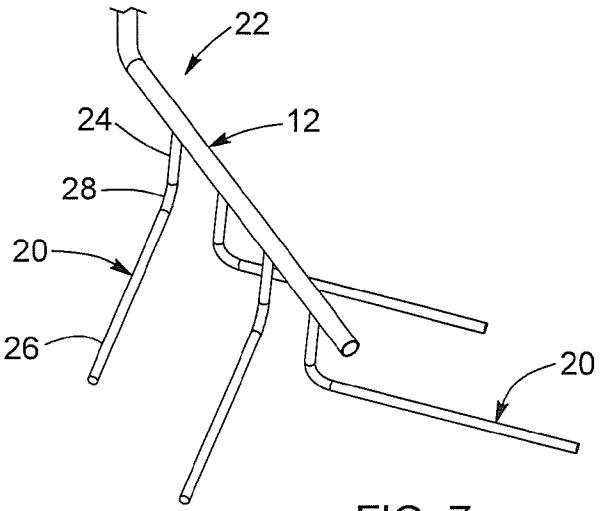

Referring to FIG. 7, the cellar well sections 20 can extend obliquely with respect to the horizontal well 12 instead of generally perpendicularly as illustrated in FIGS. 4 and 5. In FIG. 7 the cellar well sections extend with a forward angle toward the toe of the horizontal well 12, but they can be configured to extend toward the heel as well.

Figure 8:
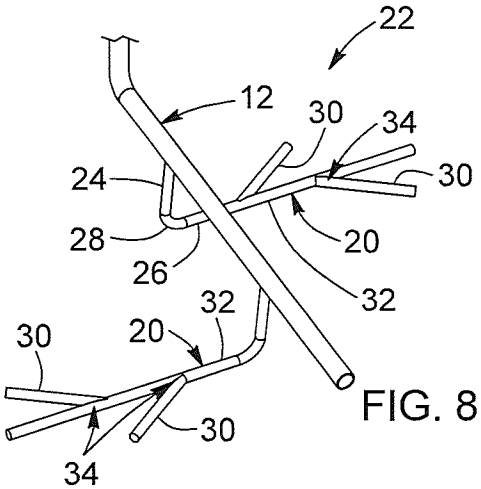

Referring to FIG. 8, the cellar well sections 20 are themselves branched well sections. At least one of the cellar well sections 20 can include at least one branch subsection 30 extending outwardly from a main portion 32 of the cellar well section 20. The cellar well section 20 can include a bifurcation portion 34 to connect the at least one branched subsection 30 to the main portion 32.

Figure 9:
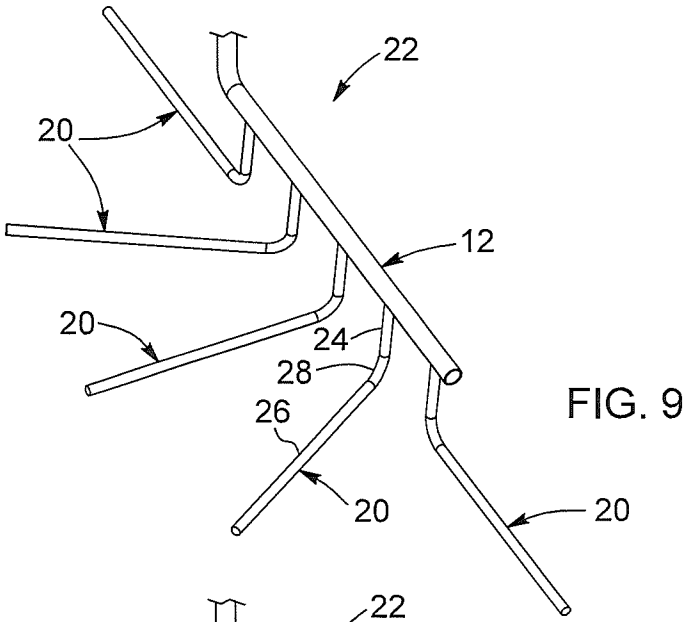

Referring to FIG. 9, the cellar well sections 20 can be configured in a fan like arrangement. The cellar well section 20 proximate the toe of the horizontal well 12 can extend beyond the toe extremity, and the cellar well section 20 proximate the heel of the horizontal well 12 can extend beyond the heel extremity. Some of the cellar well sections 20 in this fan like configuration can be provided with branch subsections 30 that can be provided nearer to the extremity of the cellar well sections 20 where the well coverage is more spread out.

Figure 10:
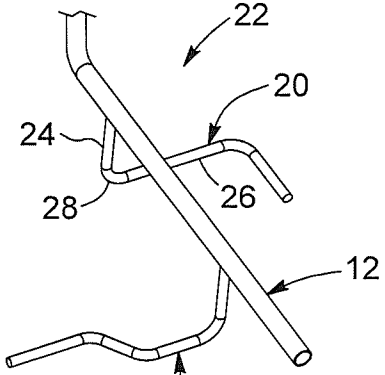

Referring to FIG. 10, the cellar well sections 20 can have a bending configuration. The bends in the lateral portions can be on the same general horizontal plane or they can enable vertical variations. The bends can enable the cellar well section to bypass geological barriers, such as underburden projections or elevations, to access certain target zones of the cellar region and/or to increase the well coverage in the cellar region.

Figure 11:
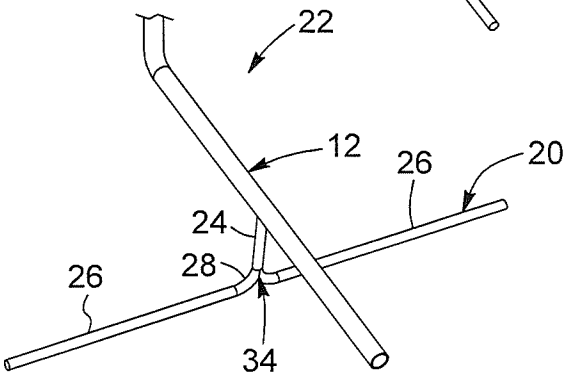

Referring to FIG. 11, the cellar well section 20 can include a single vertical portion 24 bifurcating into two lateral portions 26 that can extend in opposing directions.

Figure 12:
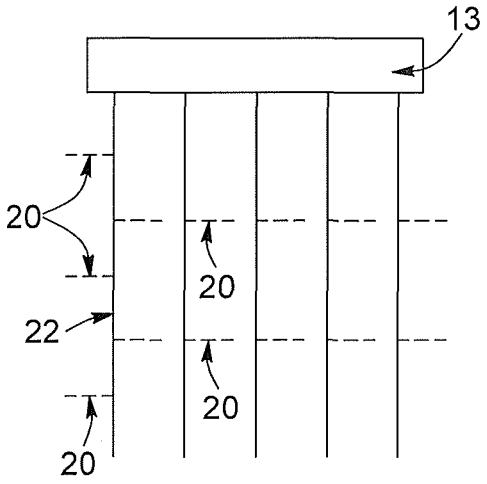
FIGS. 12 to 14 are top view schematics of arrays of wells extending from a well pad and at least one branched production well with cellar well sections.
Figure 13:
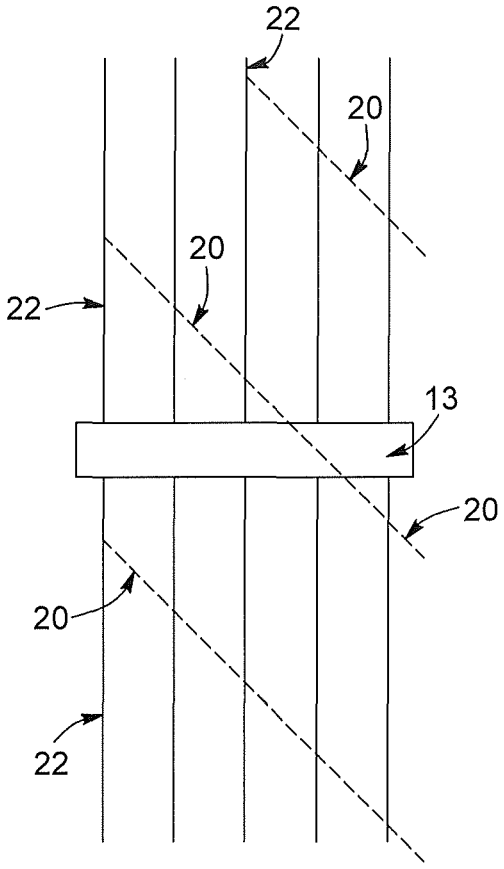
Figure 14:
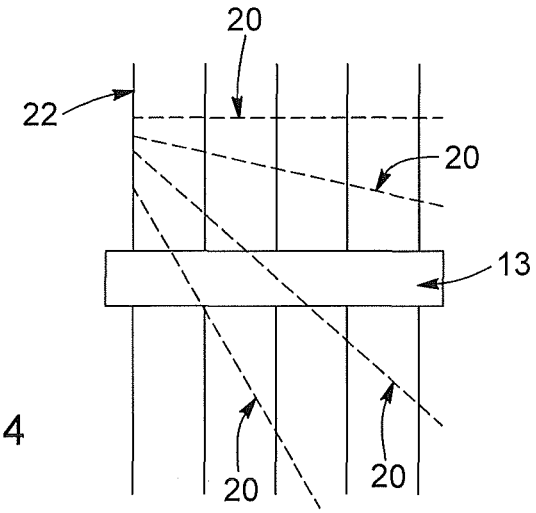

FIGS. 12 to 14 are top plan schematic views showing a well pad 13 from which multiple well pairs extend. Each well pair includes an overlying injection well and an underlying production well, and thus in FIGS. 12 to 14 the well pair is represented by a single line due to the overhead viewpoint.

Referring still to FIGS. 12 to 14, in practice the cellar well sections 20 can be provided in a thermal in situ recovery operation that includes multiple existing horizontal wells extending from a common well pad 13. In the illustrated scenarios, there are several SAGD well pairs in generally parallel relation to each other. The cellar well sections 20 can be provided extending from one or more of the existing production wells of the SAGD well pairs in order to extend through the cellar region with various different well coverage patterns.

Referring to FIG. 12, the cellar well sections 20 are provided off of only one of the production wells to form the branched production well 22. In this illustrated scenario, two long cellar well sections 20 extend below all of the other SAGD well pairs and three short cellar well sections 20 extend laterally outward away from the other well pairs. This type of scenario where not all of the SAGD well pairs are converted to have a branched production well can have certain advantages in that not all of the wells have to be converted, thereby efficiently and cost effectively accessing the cellar region within less re-entry drilling.

Referring to FIG. 13, where there are two arrays of SAGD well pairs extending from either side of the well pad 13, the cellar well sections 20 can be provided in a pattern to provide a given coverage of the cellar region. It should be noted that the cellar well section 20 from one side of the well pad 13 can cross below the well pad 13 and access the cellar region of the opposing array of SAGD well pairs, as illustrated for one of the cellar well sections 20 of FIG. 13.

Referring now to FIG. 14, the cellar well sections 20 can have a fan pattern extending from one of the horizontal production wells of a SAGD well pair in order to access the cellar region defined by most of that pad.

Figure 15:
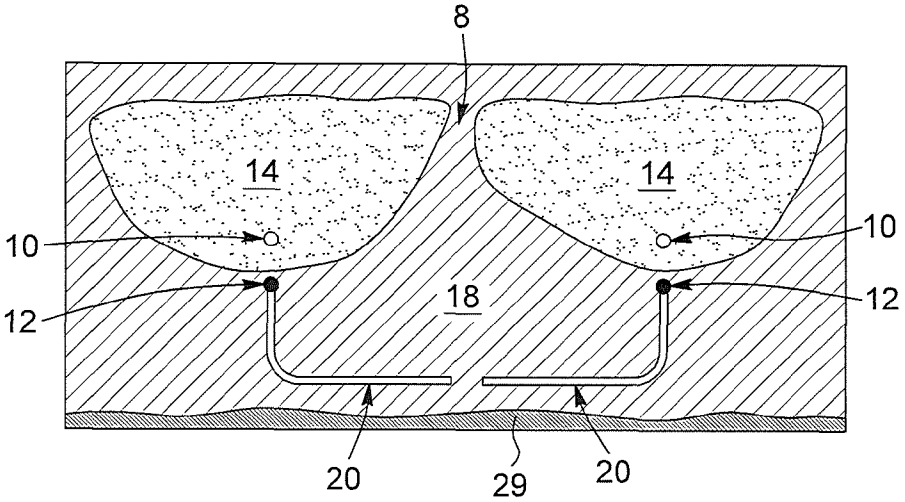
FIG. 15 is a front cross-sectional view schematic of a SAGD operation showing two SADG well pairs with cellar well sections.
Figure 16:
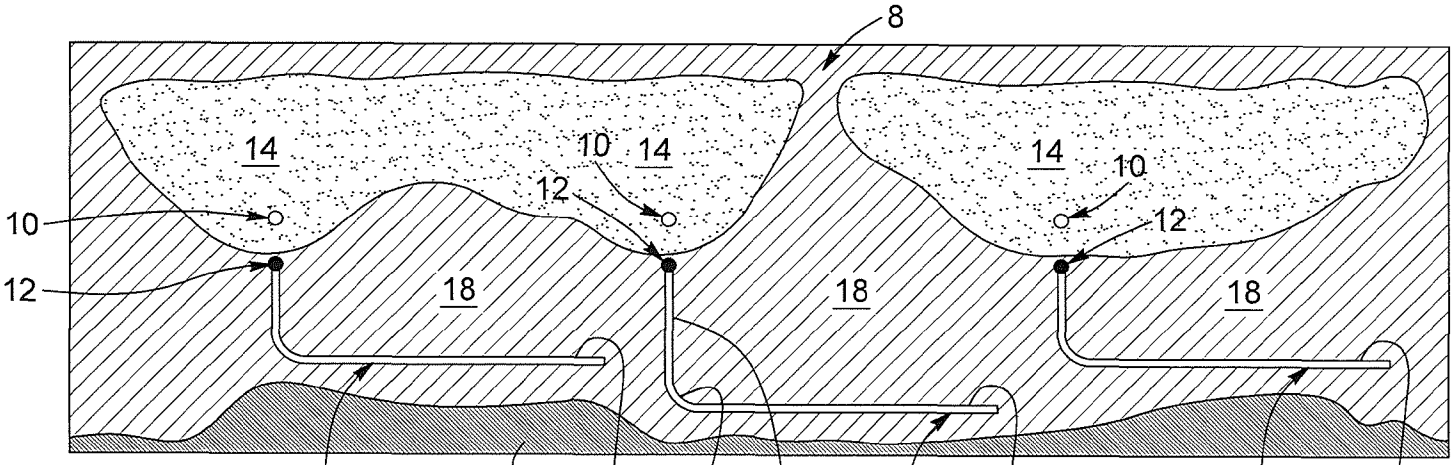
FIG. 16 is a front cross-sectional view schematic of a SAGD operation showing three SADG well pairs with cellar well sections.

FIGS. 15 and 16 illustrate other implementations where the cellar well sections 20 of adjacent SAGD well pairs extend toward each other (FIG. 15) or away from each other (FIG. 16).

It should be also understood that the configuration of the cellar well sections from a production well can differ from one cellar well section to another. The configuration, length and pattern of the cellar well sections can be provided based on a number of factors including the residual hydrocarbons in the cellar region, the topology of the underburden, the drilling technique that is employed to drill the cellar well sections, the steam chamber location and development, and so on. The cellar well sections can be arranged in a pattern for a given well pad so that the cellar region defined by most or substantially all of the SAGD well pairs is accessed by the pattern.

In some implementations, the cellar well sections extending in the same lateral direction can be spaced away from each other along the production well by a distance between about 200 m and about 40 m, or about 150 m and about 75 m, particularly for bitumen containing reservoirs. For heavy oil reservoirs, the spacing can be similar or go up to about 500 m, for example.

The cellar well sections can also be provided in accordance with certain features of the reservoir and/or the thermal in situ hydrocarbon recovery operation.

Figure 21:
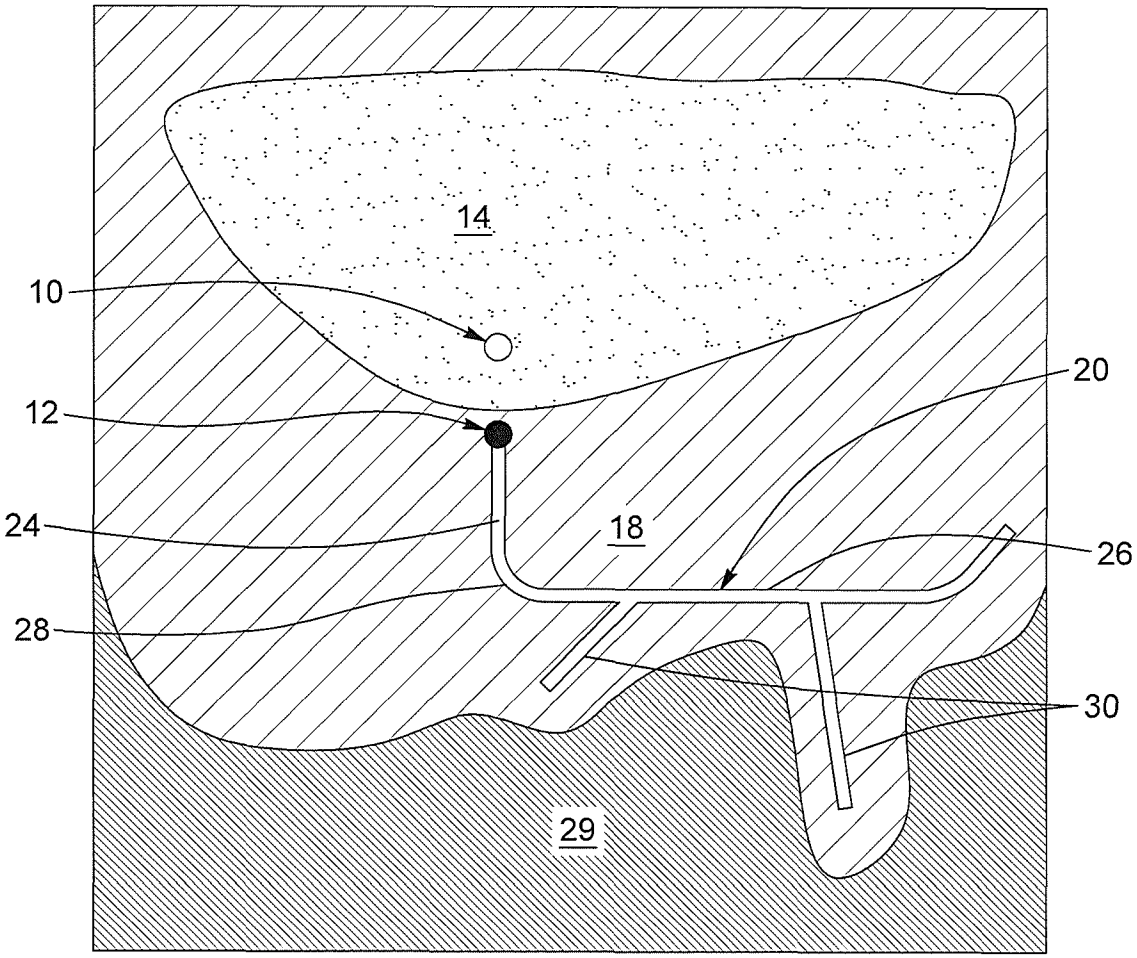
FIG. 21 is a front cross-sectional view schematic of a SAGD operation showing one SADG well pair with cellar well sections and subsections.

In some implementations, the process can include identifying residual pockets of unrecovered hydrocarbons in the cellar region and providing at least one of the cellar well sections to extend into one or each identified residual pocket. The configuration and number of cellar well sections can vary for reaching pockets of unrecovered hydrocarbons. FIG. 21 shows a scenario in which a cellar well section 20 is provided with a configuration for accessing certain target zones of the cellar region 18 with branch subsections 30.

In some implementations, the process can include identifying an underlying topological base of the cellar region and determining a depth profile of the cellar region. The depth profile can be obtained by determining the distances between the horizontal production well and the underlying topological base along a length of the horizontal production well. The underlying topological base of the cellar region can be the top of the underburden 29. The cellar well sections can be provided with configurations and arrangements in accordance with the depth profile. For example, referring to FIG. 27, the cellar well section 20 can be oriented to slope downward in the direction of the topological base. Referring to FIG. 28, the cellar well section 20 can slope upward when there is a projection in the topological base. FIG. 21 shows another scenario where the cellar well section 20 includes a generally vertical portion 24, an arcuate portion 28, a lateral portion 26, and two subsections 30 which are sloped according to two different angles and which have different lengths so as to conform to the topology of the cellar region 18.

Referring back to FIG. 3*a*, it should be noted that the cellar depth D can vary along the length of a given horizontal production well 12. This can be due to the trajectory of the production well 12 and/or the level of the underlying topological base. The location of the cellar well sections 20 can also be based on the temperatures in the cellar region, such that the cellar well sections 20 are provided in high temperature zones. For instance, the cellar depth D at certain locations along the length of the production well 12 can be sufficiently large that the bottom of the cellar region has a relatively low temperature while the remaining overlying part of the cellar region has a temperature sufficiently high that the hydrocarbons are mobile and can be directly produced. In some scenarios, the cellar well sections 20 can be provided within a zone having sufficient hydrocarbon mobility for direct production. For example, the cellar well sections can be provided at a well depth of up to about 15 m, about 10 m, about 5 m below the horizontal production well 12. Cellar well sections can be provided at a well depth between about 2 m and about 10 m, about 3 m and about 7 m or about 4 m and about 5 m, below the horizontal production well 12.

In some implementations, the process can include determining one or more cellar temperatures within the cellar region. The cellar well sections can be provided in zones having a temperature sufficiently high that the cellar hydrocarbons are mobile and can be directly produced or produced with a small amount of energy input. The cellar temperatures can be measured with downhole equipment, estimated using simulations or calculations, or determined by other means. Depending on the nature of the reservoir and the cellar hydrocarbons, the mobility temperature sufficient for producing the cellar hydrocarbons can vary. For example, in some scenarios, the cellar temperature of at least about 50° C. can be sufficient to have mobile hydrocarbons. In other scenarios, the cellar temperature can have to be at least about 80° C., at least about 90° C. or at least about 100° C.

It should nevertheless be noted that in some situations the cellar well sections can be provided in a cooler zone of the cellar region and start-up of the cellar well sections can include steam and/or solvent injection to increase the mobility of the cellar hydrocarbons.

In some implementations, the adjacent SAGD well pairs can be arranged in spaced relation to each other separated by a well spacing distance. The well spacing distance can be between about 80 m and about 150 m, for example. Referring to FIG. 15, the cellar well sections 20 can extend toward each other along half of the well spacing distance.

Figure 19:
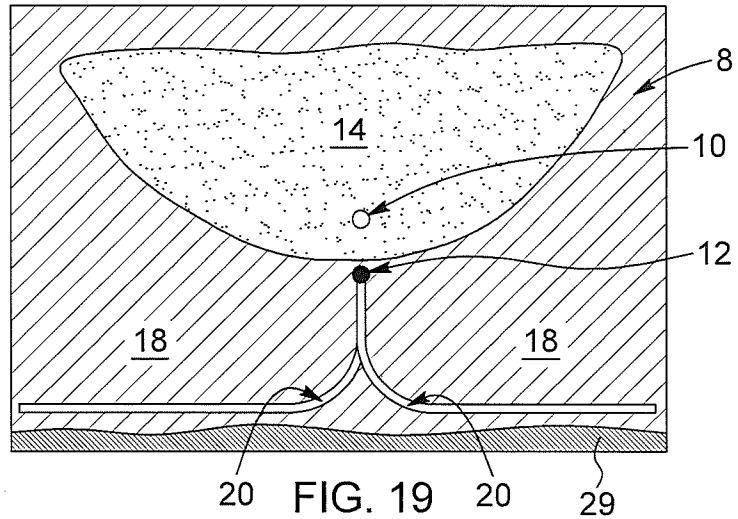
FIG. 19 is another front cross-sectional view schematic of a SAGD operation showing one SADG well pair with cellar well sections.
Figure 20:
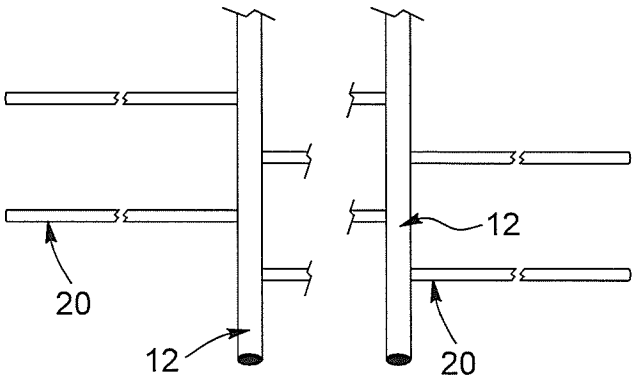
FIG. 20 is another top view schematic of a pair of production wells with cellar well sections.
Figure 17:
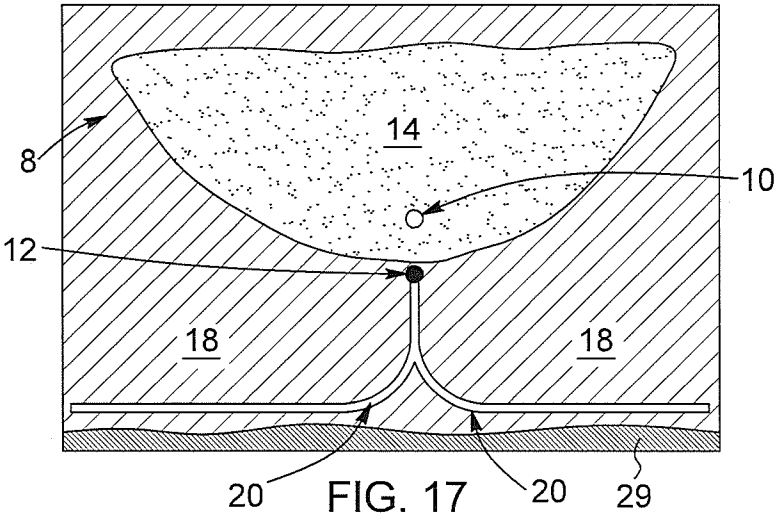
FIG. 17 is a front cross-sectional view schematic of a SAGD operation showing one SADG well pair with cellar well sections.
Figure 18:
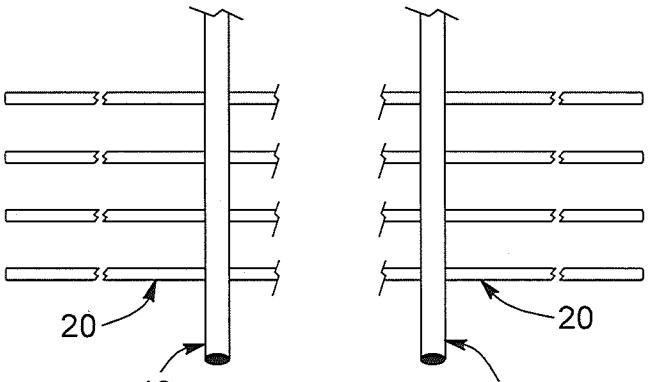
FIG. 18 is a top view schematic of a pair of horizontal production wells with cellar well sections.

In some implementations, the cellar well sections from the two adjacent well pairs can be arranged in an alternating configuration. For example, as seen on FIGS. 19 and 20, the cellar well sections 20 from one production well 12 can be arranged in a staggered relationship with the cellar well sections 20 of the adjacent production well 12. These cellar well sections 20 can further be arranged to overlap without interfering with one another. Referring to FIG. 16, each cellar well section 20 can extend towards the next adjacent production well 12 along the well spacing distance.

Pressurizing Gas Injection

In some implementations, the process can include injecting a pressurizing gas into the hydrocarbon depleted region, which can be a steam chamber, in order to provide a pressure differential sufficient for producing hydrocarbons via the cellar well sections.

In this regard, it is noted that in various implementations, the cellar well sections can be drilled at a late stage in the in situ recovery operation. At such late stages, the steam injection can still be occurring and the steam chamber can have sufficient pressure to facilitate the pressure drive for production through the branched production well including the cellar well sections. However, in scenarios where steam injection is reduced or stopped, the pressure in the steam chamber will decrease without another pressure source. It can also be advantageous to reduce or cease steam injection due to the economics and the low need for steam at the late stage of the operation. Thus, another pressurizing gas can be injected into the reservoir in order to provide the desired pressure drive for production.

In some implementations, the process includes injecting a pressurizing gas into the hydrocarbon depleted region from the SAGD injection well in order to provide sufficient pressure to allow production of the pre-heated hydrocarbons from the cellar region.

In some implementations, the pressurizing gas can be injected into the hydrocarbon depleted region to provide and maintain the pressure sufficiently higher than in the branched production well so as to facilitate production of pre-heated hydrocarbons from the cellar region. The gas injection pressure and the production well pressure can be provided or modulated in various ways, for example to promote uniform gas penetration. The pressure in the hydrocarbon depleted region can be provided up to below a fracturing pressure of the surrounding formation. For example, the pressurization can provide a minimum pressure of about 700 kPa or about 800 kPa and a maximum pressure of 10,000 kPa, about 5,000 kPa or about 3,000 kPa. In some implementations, the gas injection enables a bottom hole pressure between about 1500 kPa and about 2500 kPa. In some implementations, the gas injection enables pressure differential between pressurized steam chamber and the branched production well between about 400 kPa and about 1500 kPa or between about 700 kPa and about 1100 kPa. In scenarios where the existing SAGD or other thermal in situ recovery operation has relatively low pressures in the hydrocarbon depleted region, the pressurizing gas can be injected before or during start-up operation of the branched production wells in order to increase the pressure differential. In other scenarios, the initial pressure in the hydrocarbon depleted region due to steam injection can be sufficient for start-up and production from the branched production wells, and only after steam injection is decreased or ceased does injection of another pressurizing gas begin to maintain a desired pressure. Other methods of increasing the pressure differential include providing additional pumps coupled to the branched production well usually on the well pad at the surface.

It should be understood that the pressure differential that is provided depends on a number of factors such as the mobility of the hydrocarbons as well as the configuration, size and length of the branched production wells.

In some implementations, the pressurizing gas can include a non-condensable gas, such as carbon dioxide or nitrogen. The pressurizing gas can also include a light solvent, such as methane, propane or butane. The pressurizing gas can also include production gas from the same or a different in situ operation. The use of solvent based pressurizing gas can facilitate pressurization of the chamber as well as some additional hydrocarbon recovery from the upper part of the reservoir.

It should also be noted that in some scenarios the thermal in situ operation continues to operate with steam injection after the cellar well sections are installed and begin to operate. Steam injection can continue at a reduced rate or steam and another gas, such as a non-condensable gas, can be co-injected. In some scenarios, the cellar well sections are drilled so as to have a portion located in a pre-heated zone of the cellar region from which hydrocarbons can be immediately produced, and another portion located in a cooler zone of the cellar region where additional heat and/or dilution are required to mobilize the hydrocarbons sufficiently to enable production. In such a case, the injection of steam can facilitate the continued development of the steam chamber and conduction of heat into the cooler zone.

In some implementations, the pressurising gas can be injected through an existing injection well, such as the SAGD injection well 10 illustrated in various Figures.

Figure 22:
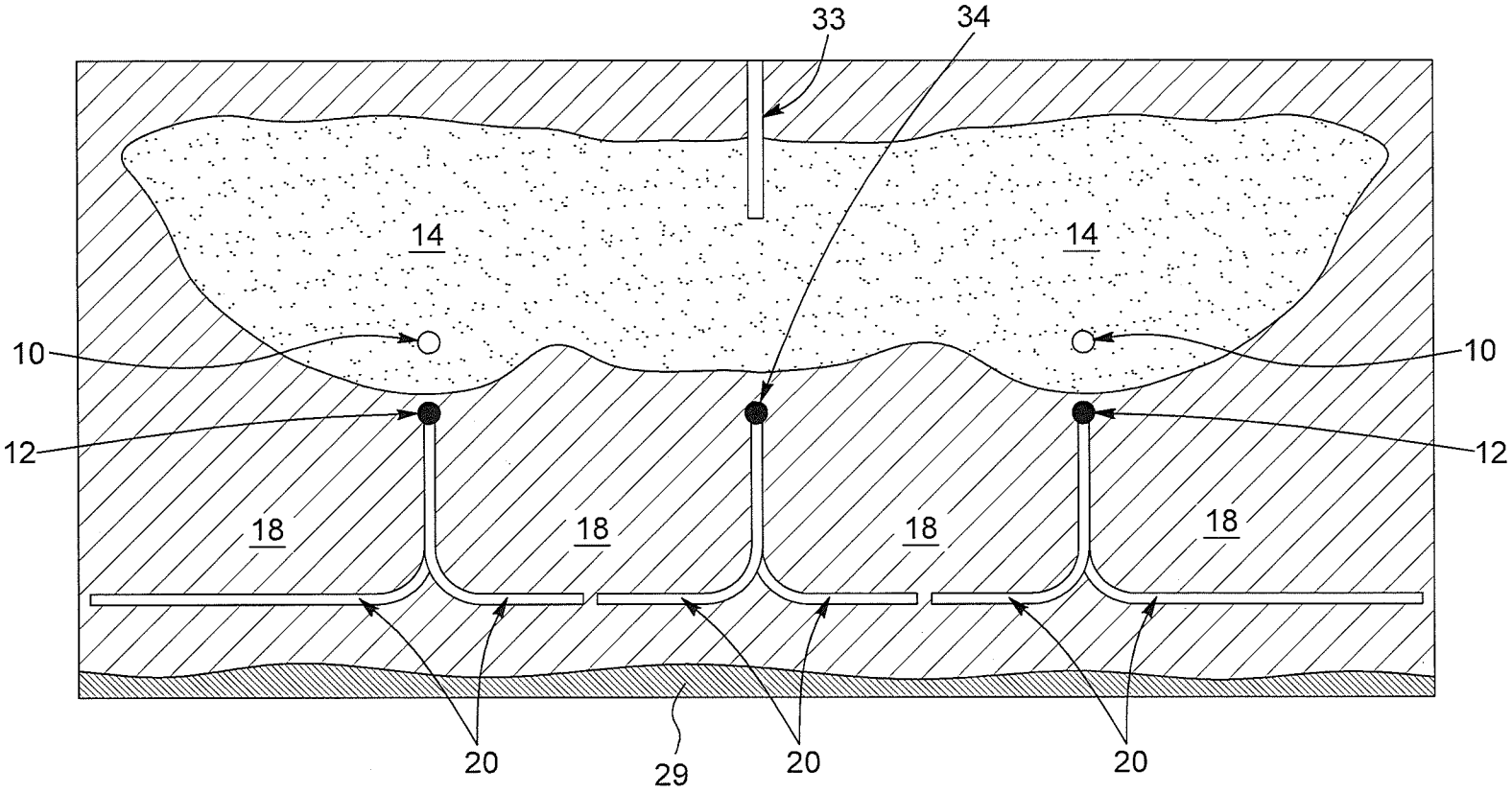
FIG. 22 is a front cross-sectional view schematic of a SAGD operation showing two SADG well pairs with cellar well sections, an infill well with cellar well sections and a gas injection well.
Figure 23:
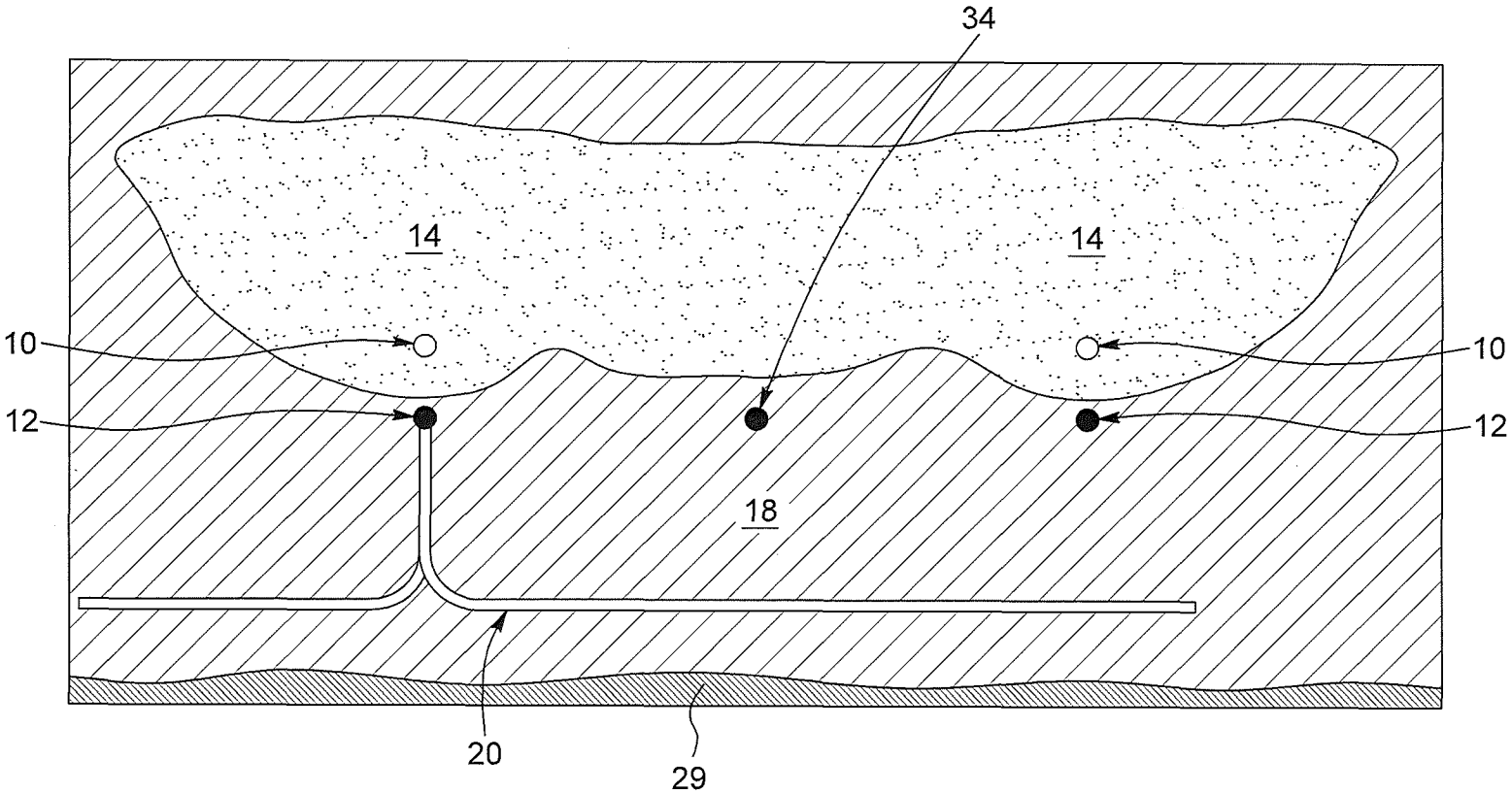
FIG. 23 is a front cross-sectional view schematic of a SAGD operation showing two SADG well pairs, one of which having cellar well sections, and an infill well.

Referring to FIG. 22, the pressurizing gas can also be injected through a separate injection well 33, which can extend vertically into the hydrocarbon depleted region or steam chamber 14. The gas injection well can also be disposed horizontally in the hydrocarbon depleted region. In various scenarios, the steam chambers 14 of several SAGD well pairs will have coalesced, as illustrated in FIGS. 16, 22, 23 and 25, and the pressurizing gas can be injected through one or more of the injection wells 10, while the other injection wells are either shut in or continue in steam injection mode.

The pressure differential can also be provided in order to avoid gas coning. Lower pressures in the branched production well and/or higher pressures in the steam chamber can provide a greater pressure differential, which can enable more rapid hydrocarbon recovery but can lead to a more unstable operation including gas coning. Higher pressures in the branched production well and/or lower pressures in the steam chamber can provide a lower pressure differential, which can lead to slower hydrocarbon recovery but with a more stable operation and lower energy consumption.

Drilling of the Cellar Well Sections

The cellar well sections can be drilled in accordance with various techniques depending on the configuration of the cellar well section, subsequent completion, reservoir characteristics, and so on.

In some implementations, providing at least one of the cellar well sections includes drilling a cellar wellbore from a bottom region of the horizontal production well. Since the previously operating horizontal production well will typically be completed with tubing or liner structures, the cellar wellbore drilling can start by drilling through a window of the tubing or liner to being the cellar wellbore. The drilling can be performed according to various re-entry drilling techniques, such as conventional drilling, coiled tubing drilling, drill-in fluids projection or other suitable techniques.

When there are multiple cellar well sections extending from a horizontal production well, the drilling of the cellar wellbores is performed sequentially and the resulting branched production well is then operated. In some scenarios, when multiple branched production wells are envisioned, a first set of cellar wellbores can be drilled to form the first branched production well that is operated in production mode and, subsequently, a second set of cellar wellbores can be drilled to form the second branched production well that is then operated in production mode. Thus, the branched production wells can be drilled and come on line serially.

It should also be understood that the drilling of the cellar wellbores is not limited to re-entry drilling. The drilling of the cellar wellbores can be performed at the time of drilling the original production well (e.g. the SAGD horizontal production well), before operation of the SAGD process and before the formation of the hydrocarbon depleted region. In such scenarios, since the cellar hydrocarbons are not yet heated, the cellar well section would not produce hydrocarbons for a period of time until sufficient heat transfer has occurred. The cellar well sections can therefore be provided from the beginning of the bitumen production operations and can produce hydrocarbons after an adequately heated cellar region is formed.

In addition, new SAGD well drilling and completion can be conducted in order to facilitate future re-entry drilling of cellar wellbores. Predetermined locations on the completions can have structural features facilitating drilling, completion or connection of a cellar well section with the original horizontal production well.

Surveying and Identifying Unrecovered Hydrocarbons

Prior to drilling the cellar wellbores, locations can be determined for providing the cellar well sections. In some implementations, a method of determining locations to provide cellar well sections extending from a horizontal production well includes identifying recoverable zones of hydrocarbons in a hydrocarbon bearing cellar region located below the horizontal production well; and determining cellar wellbore drilling trajectories each extending from locations along the production well into the recoverable zones in the cellar region.

The recoverable zones can be identified by identifying hydrocarbon viscosities in the cellar region that are sufficiently low to enable production via the cellar well sections; identifying hydrocarbon temperatures in the cellar region that are sufficiently high to enable production via the cellar well sections; and/or identifying hydrocarbon dilution levels in the cellar region that are sufficiently high to enable production via the cellar well sections. In some scenarios, the recoverable zones can be identified by identifying an underlying topological base of the reservoir below the production well, and defining the recoverable zones vertically in between the underlying topological base and the production well.

In some implementations, determining cellar wellbore drilling trajectories can include determining a depth profile of the cellar region by determining distances between the horizontal production well and the underlying topological base along a length of the horizontal production well and/or extending outward from the production well; and planning the cellar wellbore drilling trajectories based on the depth profile to provide the cellar wellbores at or proximate to the underlying topological base while remaining within respective recoverable zones. For instance, if the reservoir base is about 7 meters below the production well, the temperature is above 80° C. from the production well to the reservoir base, and the temperature also is above 80° C. for 20 meters in one lateral direction from the production well, then a cellar well drilling trajectory can extend downward from the production well to within 1 meter of the reservoir base, and then extend in the lateral direction for at least 20 meters. In this manner, the cellar well section can facilitate recovery of pre-heated hydrocarbons in accordance with an identified pre-heated region.

In other scenarios, where the reservoir base is relatively remote from the productions well (e.g., 30 meters), the cellar wellbore trajectories can be determined based on a preheating depth, which may be about 5 to about 10 meters, for example. In such scenarios, the cellar well sections are not provided at or close to the reservoir base, but are rather provided based on the temperature of the cellar well region. For instance, the cellar wellbore trajectories can reach a depth where the temperature is above 80° C., rather than at lower depths where the temperature is lower and thus production would be impeded.

Various parameters may be considered when identifying recoverable zones and determining cellar wellbore trajectories. For instance, the hydrocarbon temperatures, the size of the zones, and the distances from the production well to the base can be considered. Information can be collected in various ways, such as from observation wells provided in the cellar region, from temperature sensors provided along the production well; and/or seismic readings.

It should also be mentioned that the surveying to determine locations for the cellar well sections can be conducted at various points in time. For example, the surveying can be done during the initial design of the SAGD production well, particularly when the cellar wellbores are to be drilled at the same time as drilling the SAGD production well. When the surveying is done at this early stage, it can be based on various simulations or calculations based on other SAGD operations for example. Alternatively, the surveying can also be done after the SAGD wells have been in operation for some time and have actually formed pre-heated cellar regions. In such cases, the surveying can include various types of empirical data, which may also be complemented with simulations or calculations.

Completion of Cellar Well Sections

In some implementations, after drilling, the process can include completing the cellar well sections. The completing can include isolation, flow control, liner insertion, gravel packing and/or various other completion techniques suitable for ensuring functionality and stability of the cellar well sections. Selection of the completion technique can depend on the configuration of the cellar well section, the data obtained during the drilling of the cellar wellbore, the characteristics of the reservoir in the cellar region, and so on. In some scenarios, the cellar wellbores can not be completed and can be operated directly as the cellar well sections.

Operation of the Cellar Well Sections

In some implementations, the cellar well sections along with the branched production well are operated in production mode directly without any injection of fluids or otherwise heating the surrounding area. The pressure provided downhole can be coordinated with the downhole pressure of the steam chamber in order to provide adequate pressure differential for production, as is discussed in detail above.

Alternatively, the branched production well can be operated with an initial steam circulation stage or steam injection stage, followed by production. For instance, in a scenario where part of the cellar well section extends relatively low in the cellar region (e.g. about 10 m below the horizontal production well) where the hydrocarbons are cooler, the circulation or injection of steam for mobilizing the surrounding hydrocarbons can be done in order to accelerate the overall rate of recovery from the cellar region. Other fluids can also be injected, such as solvent, during a start-up stage of the branched production well.

Additional Optional Implementations

Figure 26:
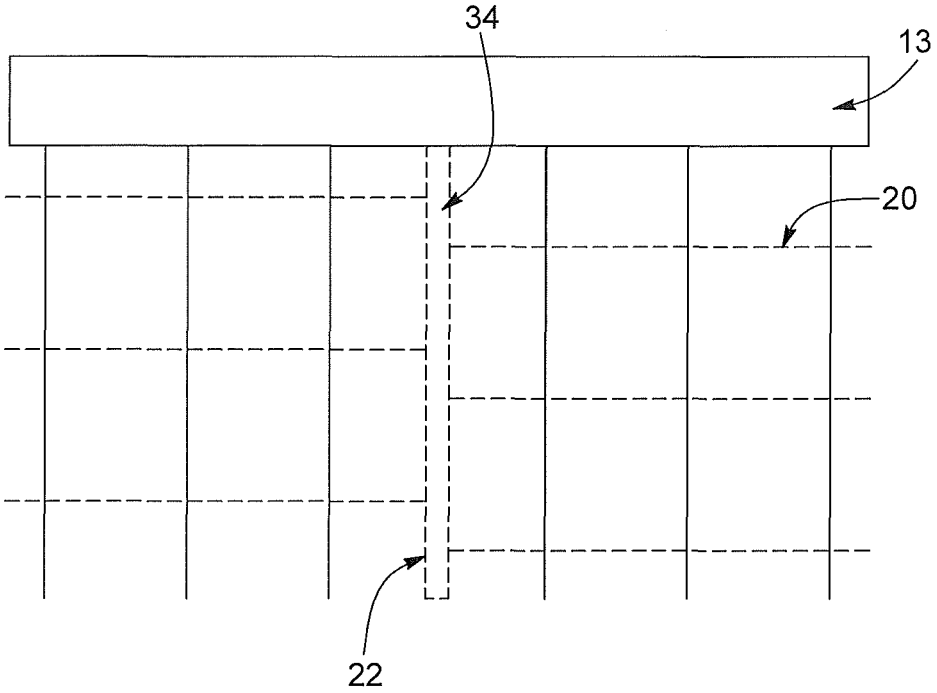
FIG. 26 is a top view schematic of an arrays of SAGD wells and an infill well extending from a well pad, with cellar well sections extending from the infill well.

In some implementations, the horizontal production well from which the cellar well sections are drilled and operated can be an infill well or a step-out well. For example, referring to FIGS. 22, 25 and 26, cellar well sections 20 can be provided extending from an infill well 34 that is drilled and operated in between two SAGD well pairs. Referring to FIG. 22, cellar well sections 20 can be provided extending from production wells 12 and the infill well 34 located in between the SAGD production wells 12. The infill well can be at a similar depth as the horizontal production wells 12. The steam chambers 14 of the SAGD well pairs can be at various stages of development depending on the operating and reservoir conditions and can be coalesced in some upper parts of the reservoir.

The infill well 34 can be drilled and operated after the SAGD well pairs have operated for a certain amount of time. The infill well 34 can then be operated in order to recover hydrocarbons from the overlying zone. The infill well 34 can then undergo re-entry drilling in order to provide the cellar well section 20, and then started up again in production mode to begin recovering cellar hydrocarbons. Alternatively, the cellar well sections can be drilled at the same time as drilling the rest of the infill well 34, in which part or all of the cellar well sections cannot be able to produce over the initial period due to insufficient mobility of the cellar hydrocarbons. Over time, as the SAGD operation develops and the cellar region is further heated, the cellar hydrocarbons can be produced.

Figure 27:
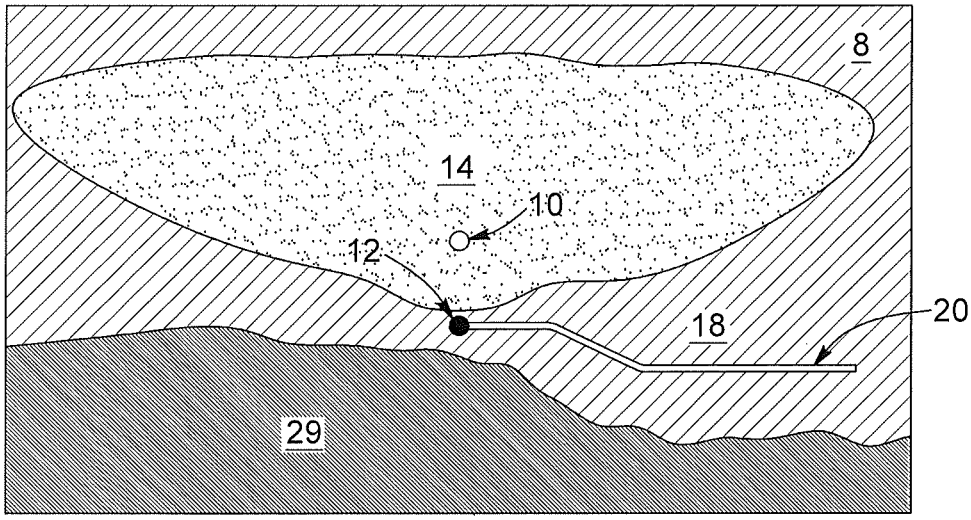
FIG. 27 is a front cross-sectional view schematic of a SAGD operation showing one SADG well pair with a cellar well section.
Figure 28:
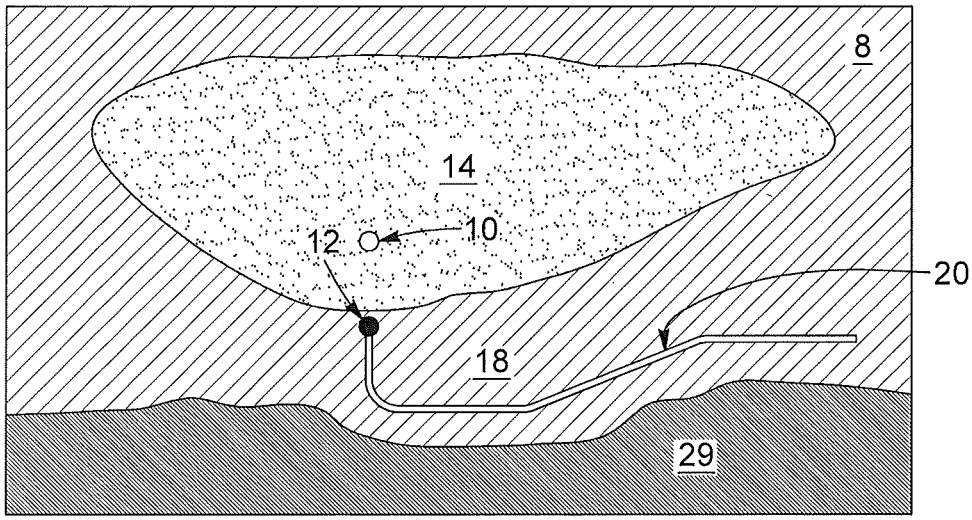
FIG. 28 is another front cross-sectional view schematic of a SAGD operation showing one SADG well pair with a cellar well section.

Referring now to FIGS. 27 and 28, the cellar well section 20 can deviate in depth depending on the topological base and/or the location of heated and accessible hydrocarbons. FIG. 27 illustrates a scenario where the cellar well section 20 has downward sloping section to access lower lying hydrocarbons. FIG. 28 illustrates a scenario where the cellar well section 20 has an upward sloping section to access higher hydrocarbons and to follow the topological base. In some other scenarios, the cellar well section 20 can extend upward to various locations, including above the level of production well, depending on the topological base and/or the location of heated and accessible hydrocarbons.

Figure 31A:
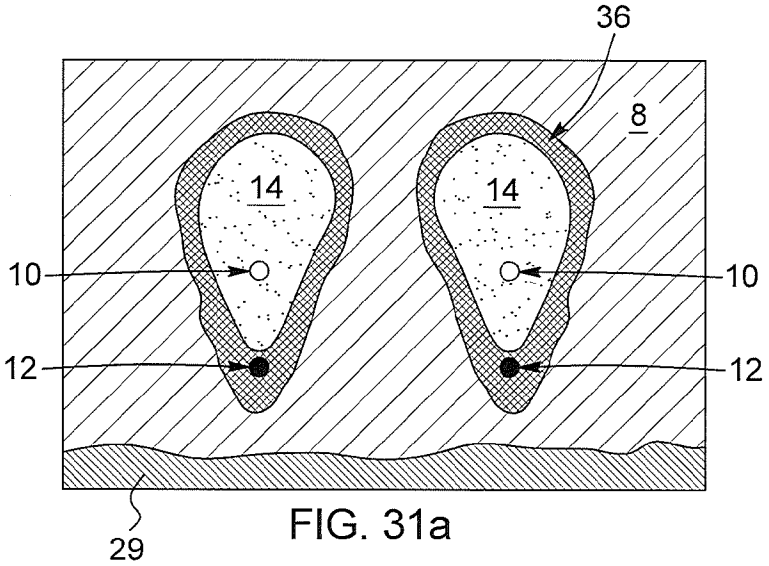
FIGS. 31*a* to 31*d* are cross-sectional view schematics of a SAGD operation with one SAGD well pair showing the development over time.
Figure 31B:
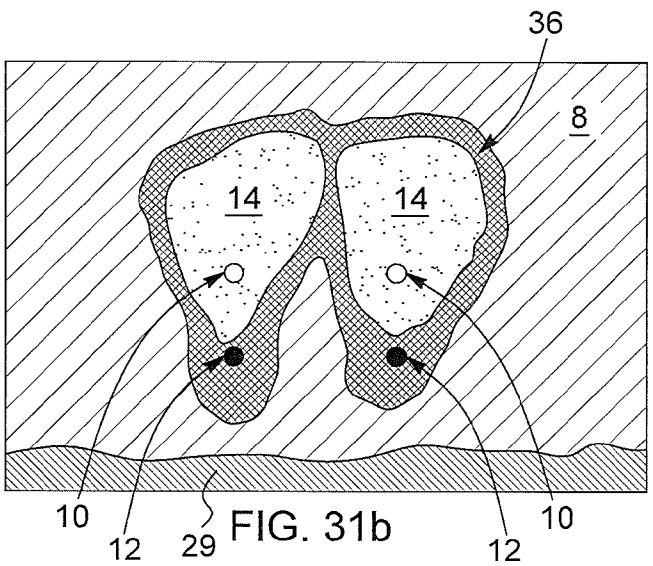
Figure 31C:
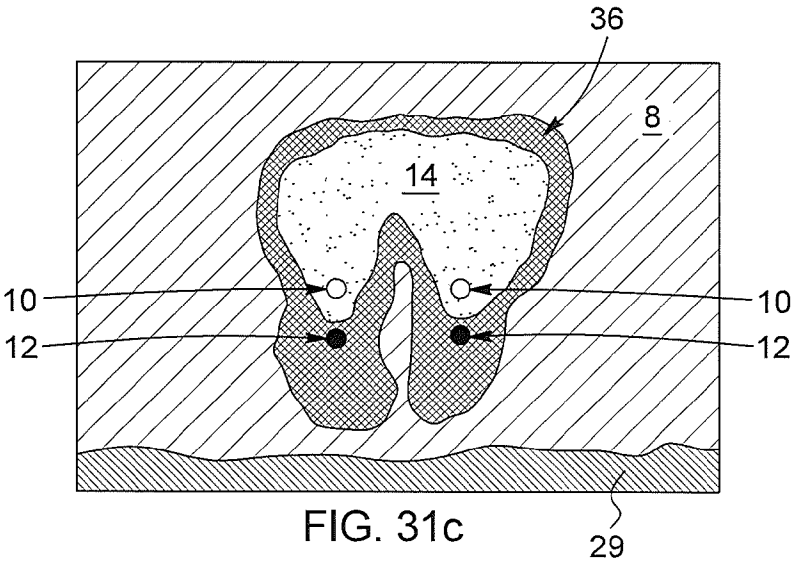
Figure 31D:
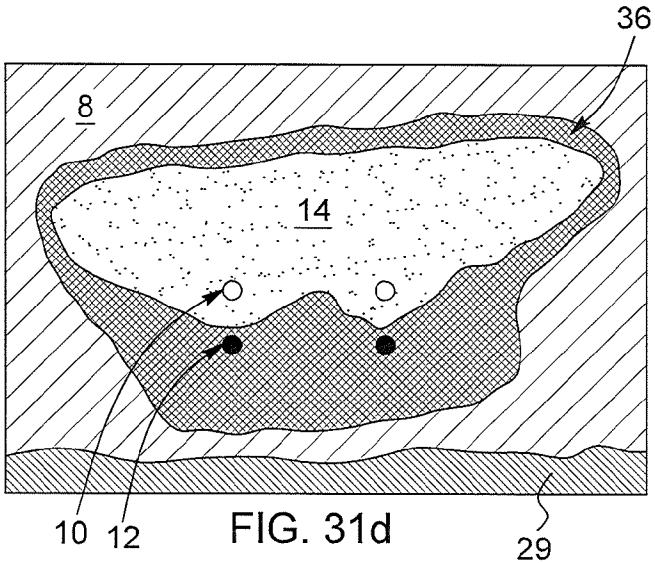

Referring now to FIGS. 31*a* to 31*d*, it should be noted that the cellar well sections can be provided in accordance with the heat transfer evolution in the cellar region. FIG. 31*a* shows two adjacent SAGD well pairs above which corresponding steam chambers 14 are formed. The steam chambers 14 are at a relatively high temperature of about 200° C., while a surrounding pre-heated zone 36 of the reservoir 8 has been heated mainly by conduction and is at a temperature between about 180° C. (close to the steam chambers 14) and about 100° C. (defined by the far limit of the surrounding pre-heated zones 36). FIG. 31*b* shows the progression of the steam chambers and the surrounding pre-heated zones 36. FIG. 31*c* shows that the steam chambers 14 have coalesced high in the reservoir. FIGS. 31 *b* and 31*c* also illustrate that the surrounding pre-heated zones 36 develop differently in different directions. In the vertical and lateral directions, the surrounding pre-heated zones 36 develop with the growth of the steam chambers 14, moving upward and outward and maintaining a generally similar thickness in those directions. In the downward direction, the pre-heated zones 36 expand toward the underburden. Since steam chamber growth and hydrocarbon production do not occur in the cellar region, the heat builds up and creates a relatively large pre-heated zone in the cellar region. FIG. 31*d* shows a later stage of the SAGD operation where the pre-heated zones of the two SAGD well pairs have formed a common pre-heated zone in the cellar region. In some scenarios, the cellar well sections are provided in the cellar region once the pre-heated zones of two adjacent SAGD well pairs have formed a common pre-heated zone in the cellar region. The pre-heated zones can be defined as having a minimum temperature for hydrocarbon production, such as a temperature of at least 80° C. in some cases.

It is also noted that certain reservoirs can have characteristics that provide advantages for cellar well sections. For example, reservoirs having mobile water in the cellar region can enable conductive and some convective heat transfer into the cellar region, thereby enabling faster pre-heating of the cellar region and/or a larger pre-heated cellar region, compared to reservoirs with immobile water. In addition, reservoirs having underburden composed of material with low heat transfer rate properties can also provide advantages in generating a pre-heated cellar region. Furthermore, reservoirs having a cellar region with high heat capacity and heat retention properties can also provide improved operation.

Branch Well Section Implementations

In some implementations, branch well sections can be provided extending from the horizontal production well into a pre-heated adjacent region in order to enhance hydrocarbon recovery. The pre-heated adjacent region can be a cellar well region located below the production well or another region that can be, for example, located beside the production well.

Figure 32:
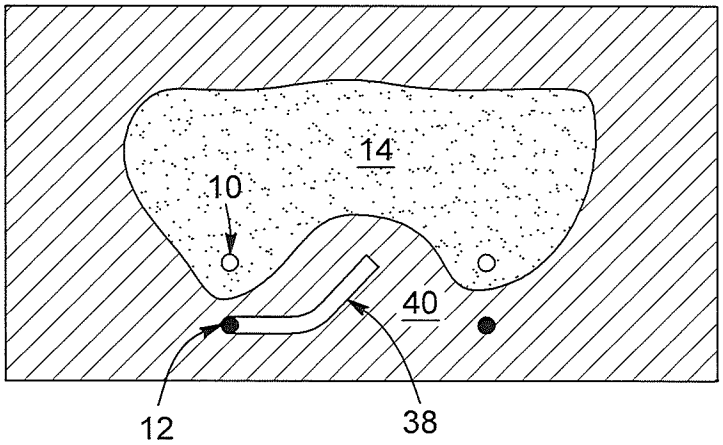
FIG. 32 is a front cross-sectional view schematic of a SAGD operation showing two SADG well pairs with a branch well section.

Referring to FIG. 32, in some implementations, a branch well section 38 extends laterally from the SAGD production well 12 into a pre-heated adjacent region 40. In this illustrated scenario, the pre-heated adjacent region 40 is an infill region with an overlying coalesced steam chamber. FIG. 32 shows a branch well section 38 that has a generally horizontal first portion extending from the production well 12 and then a second portion extending in a slanted upward direction into the pre-heated adjacent region 40. The configuration and orientation of the branch well section can be provided to prevent steam breakthrough from the steam chamber while accessing pre-heated hydrocarbons in the pre-heated infill region.

Figure 33:
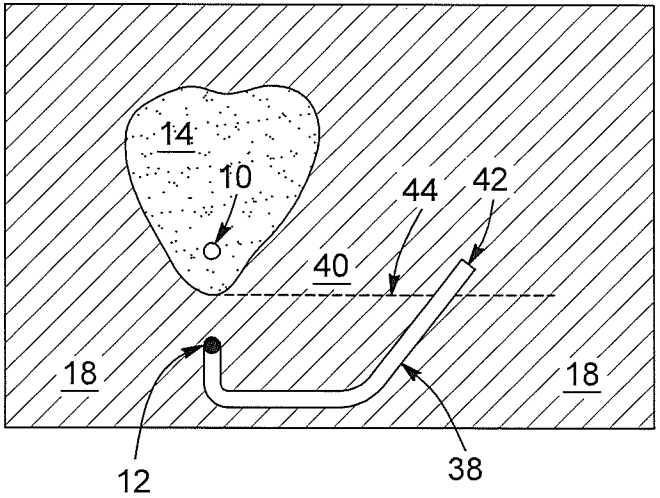
FIG. 33 is a front cross-sectional view schematic of a SAGD operation showing one SADG well pair with a branch well section.

Referring to FIG. 33, the branch well section 38 can also have other configurations, for example having a downward portion extending from the production well 12 and then horizontal, slanted and/or upward portions extending into the pre-heated adjacent region 40. The branch well section 38 can have portions that are located below, at or above a steam chamber interface height 44 while not extending into the steam chamber itself. For example, the branch well section 38 can be mainly below the interface 44 while having a distal end 42 that extends above the interface 44 at a more remote area of the pre-heated adjacent region 40.

Figure 35:
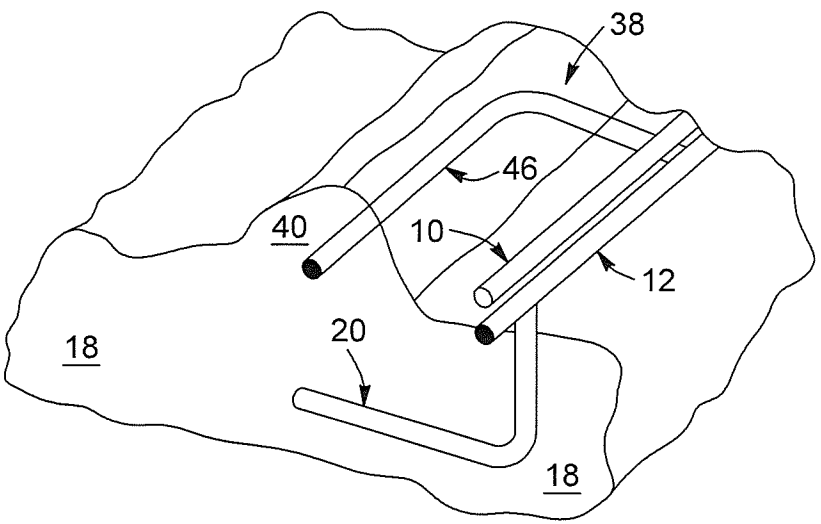
FIG. 35 is a front perspective view schematic of a SAGD operation showing one SADG well pair with a branch well section extending into an infill region and a cellar well section extending into a cellar region of the reservoir.
Figure 34:
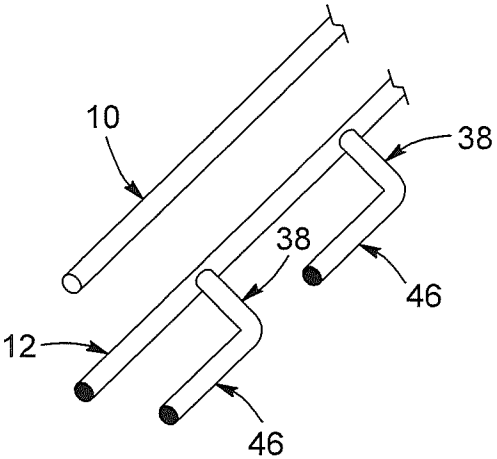
FIG. 34 is a front perspective view schematic of a SAGD operation showing one SADG well pair with two branch well sections.

Referring to FIGS. 34 and 35, one or more branch well sections 38 can extend into a pre-heated adjacent region 40 that is an infill region in between two SAGD well pairs, and can be configured to have horizontal infill portions 46 extending along the length of the infill region. These types of branch well sections 38 can also be called branch infill well sections. The branch infill well sections facilitate access to hydrocarbons in between adjacent SAGD well pairs without the need to drill new independent infill wells. One of more of the branch infill well sections can be provided in order to access infill regions.

Referring now to FIG. 35, various types of branch well sections 38 can be provided for a given production well. For example, a branch infill well section can be provided to facilitate access to a pre-heated infill region (shown as 40) while a cellar well section 20 can be provided to facilitate access to the cellar region 18. Various combinations and configurations of branch well sections can be used according to the pre-heated regions of a given in situ recover operation.

Figure 36:
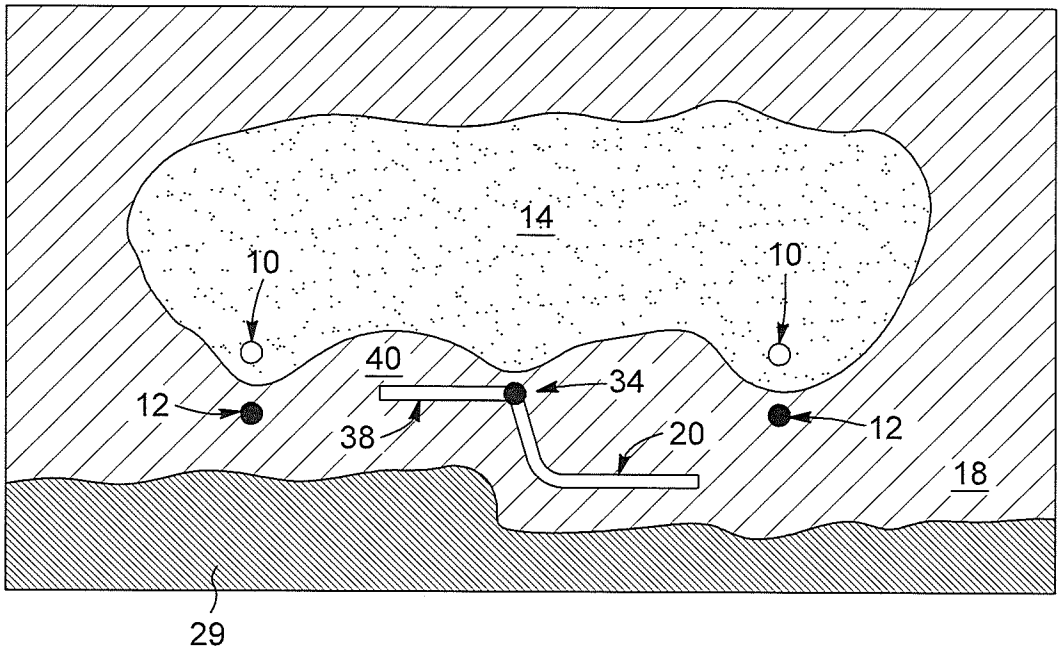
FIG. 36 is a front cross-sectional view schematic of a SAGD operation showing two SADG well pairs and an infill well with a branch well section and a cellar well section.

Referring now to FIG. 36, an infill well 34 can also be provided with a branch well section to access a pre-heated adjacent region 40 and/or a cellar well section to access a pre-heated cellar region 18. The configuration and orientation of the branch and cellar well sections can depend on the location of the base 29 as well as the temperature and quantity of the unrecovered hydrocarbons in the relevant regions.

EXAMPLES & SIMULATIONS

A simulation model was created with "CMG—Steam, Thermal, and Advanced Processes Reservoir Simulator" (STARS) to tests various aspects of hydrocarbon recovery using cellar well section techniques.

The simulation model included the following: 2D model, homogeneous reservoir, 200×900×38 meters, 1 meter blocks in width (I) and thickness (K), 4 meter cellar depth, 3 SAGD swell pairs, rock and reservoir parameters similar to MacKay River formation; refined grid in cellar region; and underburden modeled with no permeability. It is noted that one feature of the modeled reservoir is that the cellar region includes immobile water rather than mobile water, meaning that the heating of the cellar region would occur by conduction whereas the presence of mobile water would lead to a certain amount of heating by convection.

Two phases of simulations were undertaken. The first phase investigated the impact of SAGD on cellar hydrocarbons and the second phase investigated cellar well techniques for recovering the cellar hydrocarbons.

In the first phase, a conventional SAGD recovery operation was conducted and the model was adapted to include hydrocarbons in the cellar region below the production wells of the SAGD well pairs. The first phase of the simulation showed that the cellar hydrocarbons are not produced by the SAGD production wells and that these cellar hydrocarbons are heated.

In the second phase, the simulation model was modified to include an addition production well extending into the cellar region. This additional production well simulated a cellar well section. Various parameters were tested in the second phase to conduct a sensitivity analysis on the operation of the system. For instance, the system was operated with natural drainage or with gas injection, with different bottom-hole pressures (BHP) in the simulated cellar well section and location of the simulated cellar well section.

The results generally indicated that an increase in the recovery factor (RF) was obtained for all simulated scenarios using the simulated cellar well section. For the scenarios with injection of gas, the BHP of the steam chamber was maintained at 1900 kPa. In addition, the SOR equivalent metric is based on the amount of steam that could be generated by combustion of the gas (i.e. natural gas in this case) to pressurize the steam chamber. Table 1 summarizes some of the findings:

| Case | SOR equivalent | Increase in RF |
|---|---|---|
| Cellar well at 800 kPa BHP; located at 4 m depth; gas injection for 1900 kPa BHP | 2.33 | 16.73% |
| Cellar well at 900 kPa BHP; located at 4 m depth; gas injection for 1900 kPa BHP | 3.34 | 14.63% |
| Cellar well at 1000 kPa BHP; located at 4 m depth; gas injection for 1900 kPa BHP | 3.5 | 9.79% |
| Natural drainage | 0 | 6.04% |
| Cellar well located at 3 m depth; cellar well at 900 kPa BHP; gas injection for 1900 kPa BHP | 0.96 | 13.57% |
| With additional heating; cellar well at 900 kPa BHP; located at 4 m depth; gas injection for 1900 kPa BHP | 3.28 | 14.98% |
| With top injection of gas through separate well; cellar well at 900 kPa BHP; located at 4 m depth; gas injection for 1900 kPa BHP | 3.76 | 16.29 |
| With delayed gas injection; cellar well at 900 kPa BHP; located at 4 m depth; gas injection for 1900 kPa BHP | 3.35 | 14.64% |
| Gas injection for 1400 kPa BHP; cellar well at 900 kPa BHP located at 4 m depth; | 2.01 | 16.04% |
| Gas injection for 1600 kPa BHP; cellar well at 900 kPa BHP located at 4 m depth; | 2.34 | 15.71% |
| Gas injection for 1800 kPa BHP; cellar well at 900 kPa BHP located at 4 m depth; | 2.6 | 14.93% |

In general, it was found that increasing the producer BHP leads to lower hydrocarbon recovery, heating the wellbore has little to no added effect on performance, gas injection shows favorable performance and economics versus natural drainage, injection through the top of the reservoir with a separate injection well provides increased recovery but has high capital costs, delaying gas injection has little to no effect.

Figure 29:
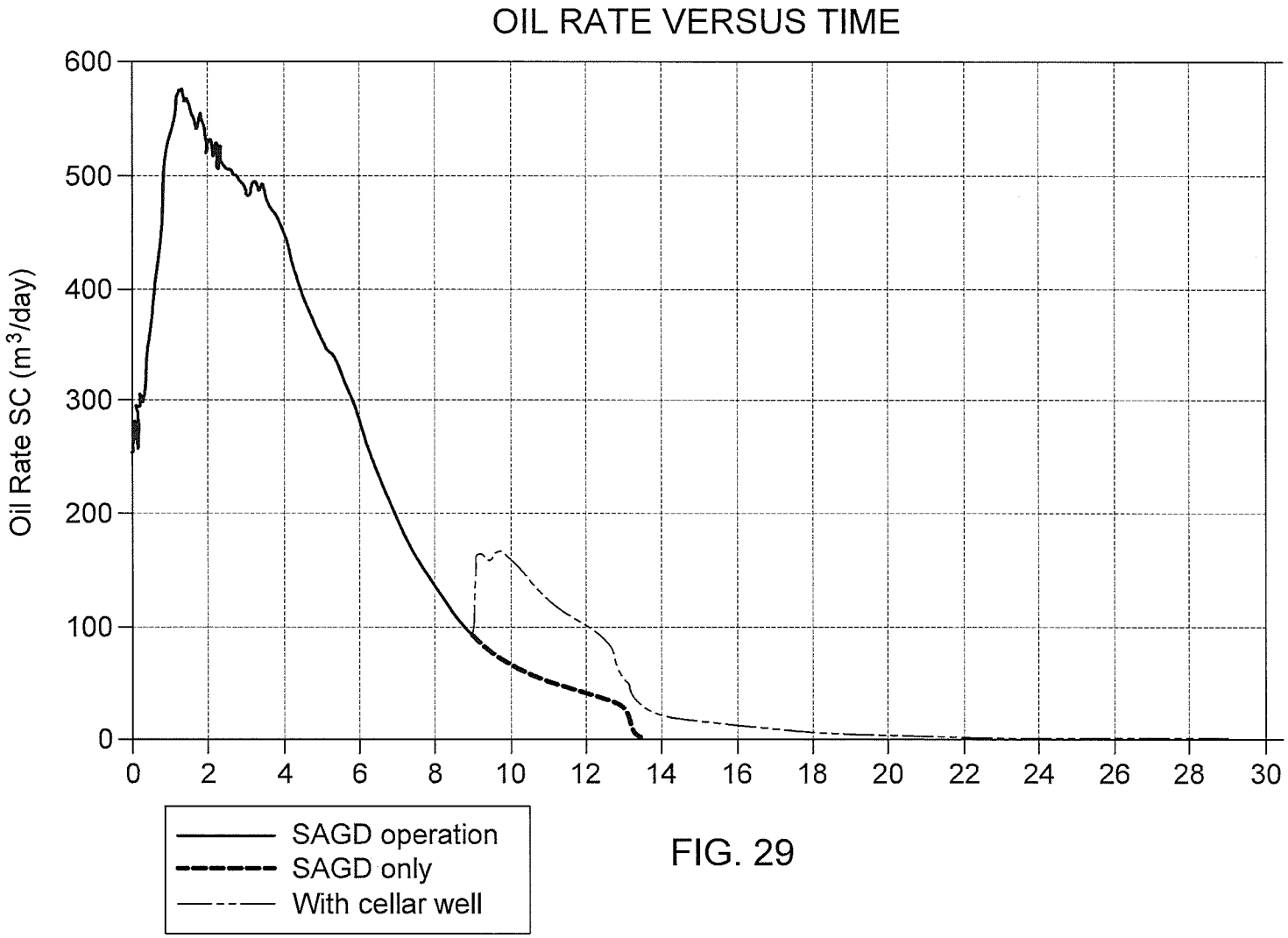
FIG. 29 is a graph of oil rate versus time.
Figure 30:
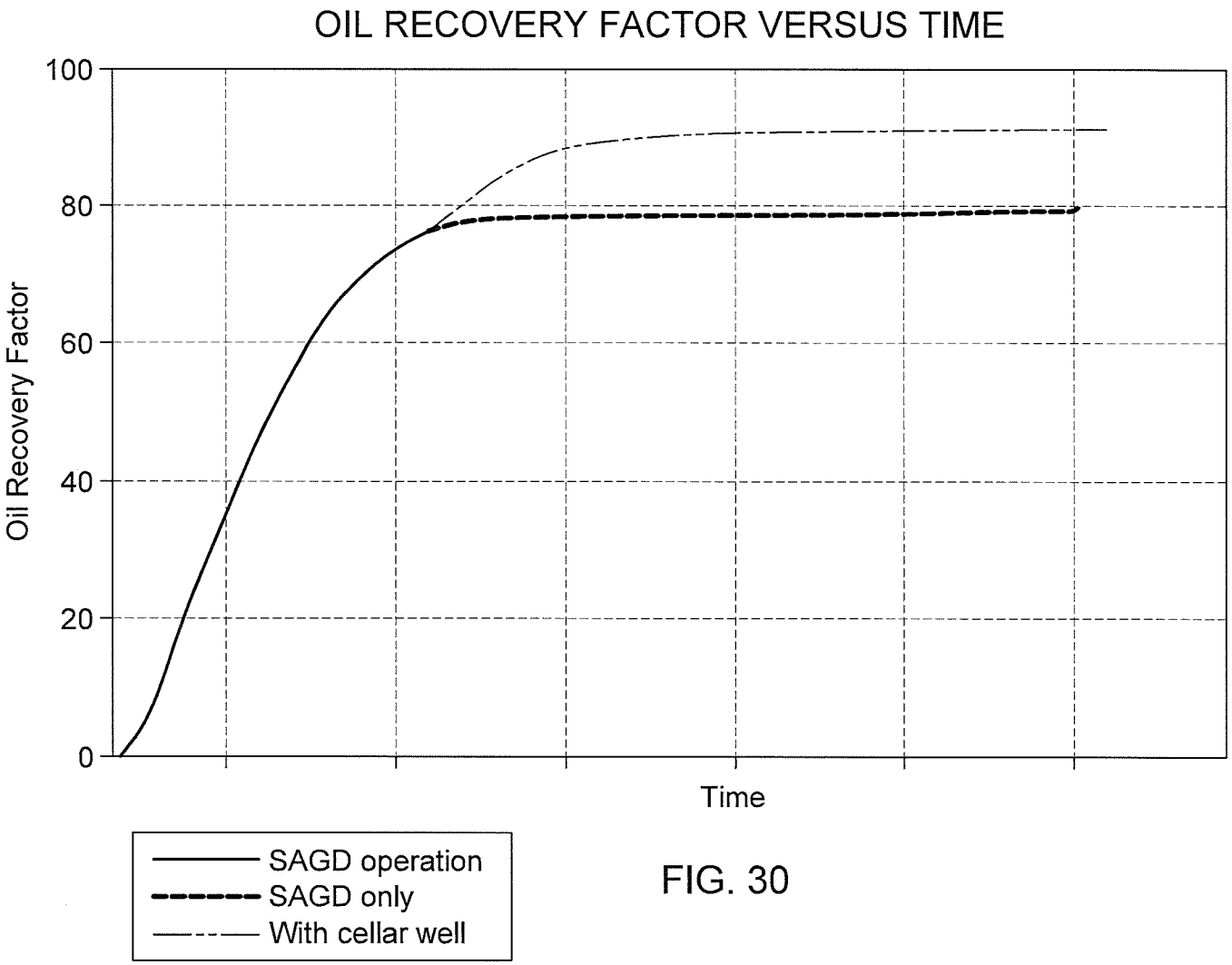
FIG. 30 is a graph of recovery factor versus time.

Referring now to FIGS. 29 and 30, the oil production rate and the oil recovery factor were plotted against time for a simulation with a cellar well with 900 kPa BHP and injection pressure of 1600 kPa BHP located at 4 meters depth. The evolution of the initial SAGD operation is illustrated followed by the effect of implementing a cellar well in the latter stages of the in situ hydrocarbon operation. The initial SAGD operation stage is conducted for 9 years during which 76% of the oil is recovered and the SOR reaches 4.1 at the end of that stage. The well constraints were as follows:

During circulation: 10 $m^3$/day of steam, 1900 kPa BHP, 217° C. using heaters simulating circulation.

During SAGD: steam injection at 1900 kPa BHP and production at 1100 kPa BHP.

Referring to FIG. 29, the initial SAGD stage is conducted for 9 years at the end of which the oil rate has significantly decreased. At the 9 year mark, the implementation of a cellar well shows a marked increase in the oil rate reaching a maximum for about 6 months and then decreasing at a relatively steady rate for several years. As a comparable, the SAGD only scenario is illustrated and shows a significantly lower oil rate, particularly over the time period of year 9 to around year 12.

Referring to FIG. 30, the initial SAGD stage is conducted for 9 years at the end of which the oil RF begins to plateau significantly at about 76%. At the 9 year mark, the implementation of a cellar well enables the RF to keep increasing until reaching a new higher plateau at about 90%.

It is also noted that various techniques described herein can be combined with other techniques described herein. For example, cellar well sections can be used with a solvent and gas assisted in situ recovery operation. Another example is that the branched production well can be provided from a step-out well with only one adjacent SAGD steam chamber. Many other examples of inter-combining one or more techniques described herein are also possible as should be apparent from the present description.

The invention claimed is:

1. A process for recovering hydrocarbons, comprising:

operating a Steam-Assisted Gravity Drainage (SAGD) in situ recovery system comprising a well pair that includes a generally horizontal SAGD injection well overlying a generally horizontal SAGD production well, thereby forming a hydrocarbon depleted region above the well pair and a hydrocarbon bearing cellar region below the well pair, the cellar region comprising hydrocarbons that have been pre-heated by the SAGD in situ recovery system;

providing at least one cellar well section extending from the SAGD production well into the cellar region, in order to form a branched production well; and injecting a pressurizing gas into the hydrocarbon depleted region from the SAGD injection well, in order to provide sufficient pressure to promote production of pre-heated hydrocarbons from the cellar region through the at least one cellar well section.

2. The process of claim 1, wherein the cellar well section comprises:

a first portion extending downward from the SAGD production well into the cellar region; and a second portion extending from a lower end of the first portion laterally within the cellar region.

3. The process of claim 1, wherein the pressurizing gas comprises a non-condensable gas.

4. The process of claim 1, wherein the at least one cellar well section comprises multiple cellar well sections arranged in spaced relation along the SAGD production well.

5. The process of claim 4, wherein the cellar well sections are arranged in an alternating configuration so as to extend into the cellar region in alternating lateral directions.

6. A process for recovering hydrocarbons, comprising:

operating a thermal in situ recovery system comprising a generally horizontal well in order to recover hydrocarbons from a reservoir, thereby forming a hydrocarbon depleted region above the horizontal well and a hydrocarbon bearing cellar region below the horizontal well, the cellar region comprising hydrocarbons that have been pre-heated by the thermal in situ recovery system;

providing at least one cellar well section extending from the horizontal well into the cellar region, in order to form a branched production well; and operating the branched production well to recover at least a portion of the pre-heated hydrocarbons from the cellar region.

7. The process of claim 6, further comprising:

providing a pressure differential between the hydrocarbon depleted region and the branched production well by injecting a pressurizing gas into the hydrocarbon depleted region.

8. The process of claim 7, wherein the pressure differential is at least 500 kPa.

9. The process of claim 8, wherein the pressure differential is at most 3000 kPa.

10. The process of claim 7, wherein the pressurizing gas comprises a non-condensable gas.

11. The process of claim 7, wherein the thermal in situ recovery system comprises a Steam-Assisted Gravity Drainage (SAGD) system comprising a well pair that includes a generally horizontal SAGD injection well overlying a generally horizontal SAGD production well.

12. The process of claim 11, wherein the pressurizing gas is injected via the SAGD injection well.

13. The process of claim 6, wherein the thermal in situ recovery system comprises a Cyclic Steam Stimulation (CSS) system comprising a CSS well that is operated as the horizontal well; or the thermal in situ recovery system comprises an in situ combustion (ISC) system comprising an ISC production well that is operated as the horizontal well.

14. The process of claim 6, wherein the at least one cellar well section comprises multiple cellar well sections extending from the horizontal well.

15. The process of claim 14, wherein at least one of the cellar well sections comprises:

a generally vertical portion extending downward from the horizontal well; and a slanted or horizontal portion extending laterally outward from the generally vertical portion.

16. The process of claim 15, wherein the generally vertical portion and the slanted or horizontal portion are joined by an arcuate portion.

17. The process of claim 6, wherein providing the at least one cellar well section comprises:

drilling at least one cellar wellbore extending from a bottom region of the horizontal well.

18. The process of claim 17, wherein the drilling of the at least one cellar wellbore is performed after formation of the hydrocarbon depleted region.

19. The process of claim 17, wherein the drilling of the at least one cellar wellbore is performed before formation of the hydrocarbon depleted region.

20. The process of claim 17, wherein the at least one cellar wellbore comprises a plurality of cellar wellbores.

21. The process of claim 17, further comprising:

locating the cellar well section in accordance with a hydrocarbon temperature in the cellar region.

22. The process of claim 21, wherein the cellar well sections are located in pre-heated hydrocarbon-containing zones of the cellar region having temperatures of at least 50° C., in pre-heated hydrocarbon-containing zones of the cellar region having temperatures of at least 80° C., or in pre-heated hydrocarbon-containing zones of the cellar region having temperatures of at least 100° C.

23. The process of claim 17, further comprising:

locating the cellar well sections in accordance with a hydrocarbon viscosity in the cellar region.

24. The process of claim 17, further comprising:

identifying residual pockets of unrecovered hydrocarbons in the cellar region; and locating the cellar well sections so as to extend into corresponding identified residual pockets.

25. The process of claim 17, further comprising:

identifying an underlying topological base of the reservoir;

determining a depth profile of the cellar region by determining distances between the horizontal well and the underlying topological base along a length of the horizontal well; and providing the cellar well sections into the cellar region in accordance with the depth profile.

26. The process of claim 25, wherein the cellar well sections are located proximate to the underlying topological base, provided at a well depth between 1 m and 15 m below the horizontal well, provided at a well depth between 2 m and 10 m below the horizontal well, or provided at a well depth between 3 m and 5 m below the horizontal well.

27. The process of claim 17, wherein the thermal in situ recovery system comprises two adjacent SAGD well pairs, and wherein the horizontal wells of the respective SAGD well pairs have corresponding cellar well sections extending toward each other.

28. The process of claim 6, wherein the horizontal well comprises a horizontal production well.

29. The process of claim 6, wherein the thermal in situ recovery system comprises a solvent-assisted system in which solvent is injected into the reservoir, and the cellar region comprises hydrocarbons that have been pre-diluted by a portion of the solvent.

30. The process of claim 6, wherein the horizontal well comprises a well that is operable for injection of steam.

31. The process of claim 30, wherein the horizontal well comprises a step-out well; wherein the horizontal well comprises an infill well; or wherein the horizontal well comprises a production well that is located below an overlying injection well.

32. The process of claim 31, wherein the overlying injection well is configured to inject non-condensable gas.

33. A process for recovering hydrocarbons, comprising:

operating a solvent-assisted in situ recovery system comprising a generally horizontal well in order to recover hydrocarbons from a reservoir, thereby forming a hydrocarbon depleted region above the horizontal well and a hydrocarbon bearing cellar region below the horizontal well, the cellar region comprising hydrocarbons that have been pre-diluted by the solvent-assisted in situ recovery system;

providing at least one cellar well section extending from the horizontal well into the cellar region in order to form a branched production well; and operating the branched production well to recover at least a portion of the pre-diluted hydrocarbons from the cellar region.

34. A process for recovering hydrocarbons, comprising:

operating a thermal in situ hydrocarbon recovery system in order to recover hydrocarbons from a reservoir, thereby forming a hydrocarbon depleted region above the horizontal well and a hydrocarbon bearing cellar region below the horizontal well, the cellar region comprising hydrocarbons that have been pre-heated by the thermal in situ recovery system;

wherein the thermal in situ hydrocarbon recovery system comprises a generally horizontal well and the horizontal well comprises a cellar well section extending from the horizontal well into the cellar region for recovering pre-heated hydrocarbons from the cellar region.

35. A process for providing a branched horizontal well in a thermal in situ recovery system, the thermal in situ recovery system comprising a generally horizontal well in order to recover hydrocarbons from a reservoir, the horizontal well being configured to recover hydrocarbons and form a hydrocarbon depleted region above the horizontal well and a hydrocarbon bearing cellar region located below the horizontal well, the process comprising:

drilling at least one cellar wellbore extending from the horizontal well into the cellar region and configured to recover pre-heated hydrocarbons from the cellar region, the horizontal well and the at least one cellar wellbore forming the branched horizontal well.

36. The process of claim 35, wherein the at least one cellar wellbore comprises multiple cellar wellbores arranged in spaced relation along the horizontal well, the cellar wellbores being drilled in spaced relation to each other along the horizontal well.

37. The process of claim 36, wherein the cellar wellbores are drilled in an alternating configuration so as to extend into the cellar region in alternating lateral directions.

38. The process of claim 36, wherein each of the cellar wellbores comprises:

a first wellbore portion extending downward from the production well into the cellar region; and a second wellbore portion extending from a lower end of the first portion laterally within the cellar region.

39. A process of determining locations to provide cellar well sections extending from a horizontal production well configured to recover hydrocarbons from a reservoir, the process comprising:

identifying recoverable zones of hydrocarbons in a hydrocarbon bearing cellar region located below the horizontal production well; and determining cellar wellbore drilling trajectories each extending from locations along the production well into the recoverable zones in the cellar region;

wherein the step of identifying recoverable zones comprises:

measuring hydrocarbon properties utilizing at least one of the following: downhole equipment, temperature sensors, and seismic reading devices; and wherein the step of identifying recoverable zones comprises at least one of the following:

identifying hydrocarbon viscosities in the cellar region that are sufficiently low to enable production via the cellar well sections;

identifying hydrocarbon temperatures in the cellar region that are sufficiently high to enable production via the cellar well sections; and identifying hydrocarbon dilution levels in the cellar region that are sufficiently high to enable production via the cellar well sections.

40. The process of claim 39, wherein the step of identifying recoverable zones further comprises:

identifying an underlying topological base of the reservoir below the production well, the recoverable zones being vertically defined in between the underlying topological base and the production well.

41. The process of claim 40, wherein the step of determining cellar wellbore drilling trajectories comprises:

determining a depth profile of the cellar region by determining distances between the horizontal production well and the underlying topological base along a length of the horizontal production well and/or extending outward from the production well; and planning the cellar wellbore drilling trajectories based on the depth profile to provide the cellar wellbores at or proximate to the underlying topological base and remaining within respective recoverable zones.

42. A thermal in situ recovery system for recovering hydrocarbons from a reservoir, the system comprising:

a production well having a generally horizontal portion provided in the reservoir in between an upper hydrocarbon depleted region and a lower hydrocarbon bearing cellar region, the cellar region comprising hydrocarbons that have been pre-heated by the thermal in situ recovery system;

at least one cellar well section extending from the production well into the cellar region, the production well and the at least one cellar well section thereby forming a branched production well for recovering at least a portion of the pre-heated hydrocarbons from the cellar region; and a pressurisation system comprising:

an injection well located in the upper hydrocarbon depleted region and configured to inject a pressurizing gas into the hydrocarbon depleted zone; and a pressure regulator for regulating a downhole pressure differential between the branched production well and the hydrocarbon depleted zone in order to promote production of pre-heated hydrocarbons from the cellar region.

43. A process for recovering hydrocarbons, comprising:

operating a Steam-Assisted Gravity Drainage (SAGD) in situ recovery system comprising a well pair that includes a generally horizontal SAGD injection well overlying a generally horizontal SAGD production well, thereby forming a hydrocarbon depleted region above the well pair and an adjacent hydrocarbon bearing region adjacent to the hydrocarbon depleted region, the adjacent region comprising hydrocarbons that have been pre-heated by the SAGD in situ recovery system;

providing at least one branch well section extending from the SAGD production well and extending into the adjacent region, in order to form a branched production well; and injecting a pressurizing gas into the hydrocarbon depleted region from the SAGD injection well, in order to provide sufficient pressure to promote production of pre-heated hydrocarbons from the adjacent region through the at least one branch well section.

44. The process of claim 43, wherein the adjacent region comprises a cellar region located below the SAGD production well, and the branch well section extends downward from the SAGD production well into the cellar region.

45. The process of claim 43, wherein the adjacent region is located beside the SAGD production well and the branch well section extends laterally from the SAGD production well into the adjacent region.

46. A process for selecting pre-heated hydrocarbon bearing regions for receiving branch well sections, the pre-heated regions being formed by operation of a Steam-Assisted Gravity Drainage (SAGD) in situ recovery system comprising a SAGD injection well overlying a SAGD production well, the process comprising:

identifying a hydrocarbon depleted region above the SAGD production well; and identifying hydrocarbon bearing regions that are adjacent to SAGD production well and the hydrocarbon depleted region;

determining hydrocarbon temperatures of the hydrocarbon bearing regions utilizing at least one of the following: downhole equipment and temperature sensors;

selecting pre-heated hydrocarbon bearing regions having temperatures sufficient to enable hydrocarbon production therefrom via corresponding branch well sections extending from the SAGD production well; and determining regions for receiving branch well sections.

47. The process of claim 46, wherein the steps of identifying the hydrocarbon depleted region and identifying hydrocarbon bearing regions comprise seismic surveying.

48. The process of claim 46, wherein the step of identifying hydrocarbon bearing regions comprises identifying an underlying topological base of the reservoir below the SAGD production well, the hydrocarbon bearing regions being cellar region that are vertically defined in between the underlying topological base and the production well.

49. The process of claim 46, wherein the step of determining hydrocarbon temperatures of the hydrocarbon bearing regions comprises:

measuring temperatures along the SAGD production well or from observation wells; and/or estimating temperatures based on simulations and/or calculations.

* * * * *